US011426760B2

(12) United States Patent
Nishiura et al.

(10) Patent No.: US 11,426,760 B2
(45) Date of Patent: Aug. 30, 2022

(54) POWDER FILM FORMING METHOD AND POWDER FILM FORMING DEVICE

(71) Applicant: HITACHI ZOSEN CORPORATION, Osaka (JP)

(72) Inventors: Sousuke Nishiura, Osaka (JP); Takeshi Sugiyo, Osaka (JP); Hideyuki Fukui, Osaka (JP)

(73) Assignee: HITACHI ZOSEN CORPORATION, Osaka (JP)

( * ) Notice: Subject to any disclaimer, the term of this patent is extended or adjusted under 35 U.S.C. 154(b) by 0 days.

(21) Appl. No.: 16/482,409

(22) PCT Filed: Feb. 5, 2018

(86) PCT No.: PCT/JP2018/003840
§ 371 (c)(1),
(2) Date: Jul. 31, 2019

(87) PCT Pub. No.: WO2018/143459
PCT Pub. Date: Aug. 9, 2018

(65) Prior Publication Data

US 2020/0009607 A1 Jan. 9, 2020

(30) Foreign Application Priority Data

Feb. 3, 2017 (JP) ..... JP2017-019085
Feb. 3, 2017 (JP) ..... JP2017-019089
Feb. 3, 2017 (JP) ..... JP2017-019093

(51) Int. Cl.
*B05D 1/06* (2006.01)
*B05B 5/025* (2006.01)
(Continued)

(52) U.S. Cl.
CPC ..... *B05D 1/06* (2013.01); *B05B 5/0255* (2013.01); *B05C 19/04* (2013.01); *B05D 3/12* (2013.01); *B41F 15/405* (2013.01)

(58) Field of Classification Search
CPC ..... B05D 3/12; B05D 1/06
See application file for complete search history.

(56) References Cited

U.S. PATENT DOCUMENTS 3,081,698 A 3/1963 Childress et al.
3,285,168 A * 11/1966 Childress ..... B41M 1/125 101/150
(Continued)

FOREIGN PATENT DOCUMENTS

CN 1522202 A 8/2004
CN 102196676 A 9/2011
(Continued)

OTHER PUBLICATIONS

JP2010207780, machine translation. (Year: 2010).*
(Continued)

*Primary Examiner* — Robert A Vetere
(74) *Attorney, Agent, or Firm* — Pillsbury Winthrop Shaw Pittman, LLP

(57) ABSTRACT

A powder film forming method includes the steps of: filling an opening with a powder, the opening being formed in a screen plate; and forming the powder film by generating an electric potential difference between the screen plate and a substrate so as to cause the powder, which is filling the opening, to move to the substrate.

12 Claims, 13 Drawing Sheets

(51) Int. Cl.

| | |
|---|---|
| ***B05C 19/04*** | (2006.01) |
| ***B41F 15/40*** | (2006.01) |
| ***B05D 3/12*** | (2006.01) |

(56) References Cited

U.S. PATENT DOCUMENTS

| | | | | |
|---|---|---|---|---|
| 3,450,043 | A * | 6/1969 | Flax | B41M 1/125 101/114 |
| 3,768,987 | A * | 10/1973 | Forstmann | C21D 9/52 428/557 |
| 4,903,050 | A | 2/1990 | Schmidlin | |
| 2004/0250715 | A1* | 12/2004 | Ando | B41M 1/125 101/114 |
| 2006/0219105 | A1 | 12/2006 | Ando | |
| 2008/0106587 | A1 | 5/2008 | Ando | |
| 2011/0318500 | A1* | 12/2011 | Kawaoka | B05D 1/007 427/475 |
| 2017/0136492 | A1 | 5/2017 | Matsunaga | |

FOREIGN PATENT DOCUMENTS

| | | | | | |
|---|---|---|---|---|---|
| CN | 204382785 | U | | 6/2015 | |
| JP | 57-107270 | A | | 7/1982 | |
| JP | H04-183360 | A | | 6/1992 | |
| JP | 06-328873 | A | | 11/1994 | |
| JP | 09-169103 | A | | 6/1997 | |
| JP | 2009-101665 | A | | 5/2009 | |
| JP | 2010-207779 | A | | 9/2010 | |
| JP | 2010-207780 | A | | 9/2010 | |
| JP | 2010-214296 | A | | 9/2010 | |
| JP | 2010207779 | A | * | 9/2010 | |
| JP | 2010207780 | A | * | 9/2010 | B41M 1/125 |
| JP | 2012-140016 | A | | 7/2012 | |
| JP | 2012-179786 | A | | 9/2012 | |
| JP | 2014-061703 | A | | 4/2014 | |
| JP | 2016-077982 | A | | 5/2016 | |
| JP | 2016-129954 | A | | 7/2016 | |
| WO | 2014/034598 | A1 | | 3/2014 | |

OTHER PUBLICATIONS

JP2010207779, 2010, machine translation. (Year: 2010).*

First Office Action dated Jul. 15, 2020 issued in corresponding Chinese Patent Application No. 201880009966.8 with full English translation (17 pgs.).

English translation International Preliminary Report on Patentability and Written Opinion of the International Searching Authority dated Aug. 6, 2019 issued in corresponding International Patent Application No. PCT/JP2018/003840.

English translation International Search Report dated Mar. 13, 2018 issued in corresponding International Patent Application No. PCT/JP2018/003840.

Extended European Search Report issued in corresponding EP Application No. 18747116.4 dated Dec. 16, 2019.

Notice of Reasons for Refusal dated Oct. 19, 2021, issued in corresponding Japanese Patent Application No. 2018-566157 with English translation (21 pgs.).

Notice of Reasons for Refusal dated Jan. 5, 2022, issued in corresponding Japanese Patent Application No. 2018-566157 with English translation (18 pgs.).

* cited by examiner

POWDER FILM FORMING METHOD AND POWDER FILM FORMING DEVICE

CROSS-REFERENCE TO RELATED APPLICATIONS

This Application is the U.S. National Stage of PCT/JP2018/003840, filed Feb. 5, 2018, which claims priority to Japanese Patent Application No. 2017-019085, filed Feb. 3, 2017, Japanese Patent Application No. 2017-019089, filed Feb. 3, 2017 and Japanese Patent Application No. 2017-019093 filed Feb. 3, 2017, the contents of each of which are incorporated herein by reference in entirety.

TECHNICAL FIELD

The present invention relates to a powder film forming method and a powder film forming device for forming a powder film on a substrate by a printing technique in which a fixed powder material.

BACKGROUND ART

An electrostatic screen printing method of forming a powder film by rubbing a powder into a screen with use of a rubbing body is known as a conventional technique (Patent Literature 1). An electrostatic film forming device disclosed in Patent Literature 1 includes (i) a rubbing body (screen brush) configured to rub a powder into a screen and (ii) a hopper configured to supply the powder to the rubbing body. A film thickness accuracy of a powder film, which is formed by the electrostatic film forming device, is intended to be improved by allowing the hopper and the rubbing body to operate independently of each other.

A technique for forming a powder film on a substrate with use of an electrostatic screen printing device is known (Patent Literature 2). The electrostatic screen printing device disclosed in Patent Literature 2 includes a screen plate which is a porous body. The screen plate is connected to one end of direct current power supply. A powder provided on the screen plate is rubbed into the screen plate by a rubbing body. This causes the powder to come into contact with the screen plate so as to be charged.

Due to electrostatic induction, the powder thus charged is stuck on a printed material which is connected to the other end of the direct current power supply, so that a powder film is formed.

CITATION LIST

Patent Literature

[Patent Literature 1]

Japanese Patent Application Publication, Tokukai, No. 2012-179786 (Publication date: Sep. 20, 2012)

[Patent Literature 2]

Japanese Patent Application Publication, Tokukai, No. 2012-140016 (Publication date: Jul. 26, 2012)

SUMMARY OF INVENTION

Technical Problem

According to the conventional technique disclosed in Patent Literature 1, however, uneven formation occurs to a powder film formed on a substrate from a powder rubbed into a screen with use of a rubbing body. The uneven formation occurs due to (i) a state in which the powder provided on the screen is dispersed and (ii) a track in which the rubbing body moves. This unfortunately causes a film thickness accuracy of the powder film formed with use of the electrostatic film forming device to be insufficient.

An object of an aspect of the present invention is to achieve a powder film forming method and a powder film forming device, each of which can form a powder film with good film thickness accuracy.

Solution to Problem

In order to attain the object, a powder film forming method in accordance with an aspect of the present invention is a method of forming a powder film, including the steps of: (a) filling an opening with a powder, the opening being formed in a powder filling member; and (b) forming the powder film by generating an electric potential difference between the powder filling member and a substrate so as to cause the powder, which is filling the opening, to move to the substrate.

In order to attain the object, a powder film forming device in accordance with an aspect of the present invention includes: a powder filling member having an opening to be filled with a powder; a rubbing body configured to rub the powder into the opening from one end side of the opening so as to fill the opening with the powder; and a power supply configured to generate an electric potential difference between the powder filling member and a substrate so as to cause the powder, which is filling the opening, to move to the substrate.

In order to attain the object, another powder film forming method in accordance with an aspect of the present invention includes the steps of: (a) filling an opening with a powder by vibrating the powder, the opening being formed in a powder filling member; and (b) forming the powder film by causing the powder, which is filling the opening, to move to the substrate.

Advantageous Effects of Invention

An aspect of the present invention brings about an effect of being able to form a powder film with good film thickness accuracy.

Figure 4:
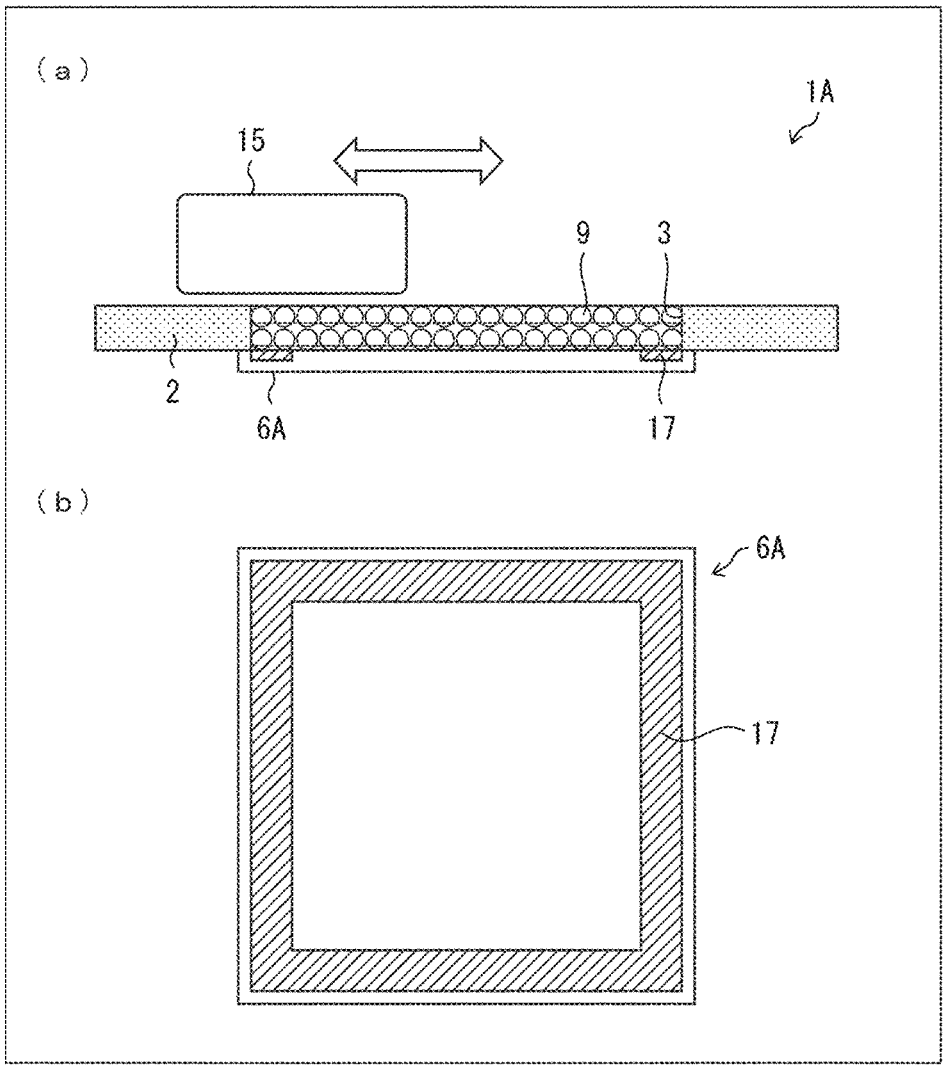

(a) of FIG. 4 is a cross-sectional view illustrating a filling step in a powder film forming method in accordance with Embodiment 2. (b) of FIG. 4 is a plan view illustrating a holding plate in accordance with Embodiment 2.

Figure 5:
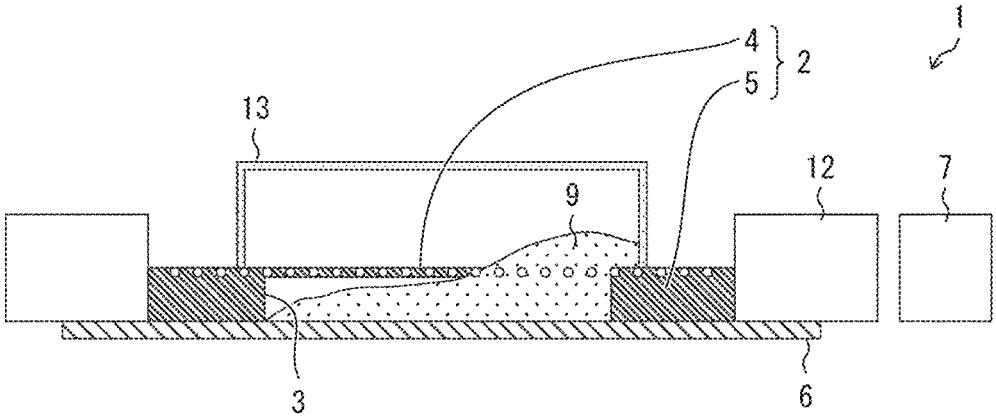

FIG. 5 is a cross-sectional view illustrating a filling step in a powder film forming method in accordance with Embodiment 4.

Figure 6:
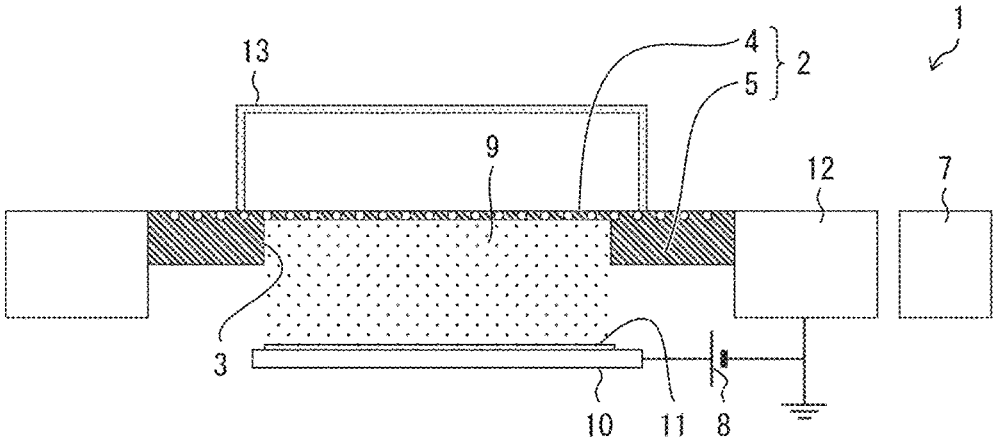

FIG. 6 is a cross-sectional view illustrating a film forming step in the powder film forming method.

Figure 7:
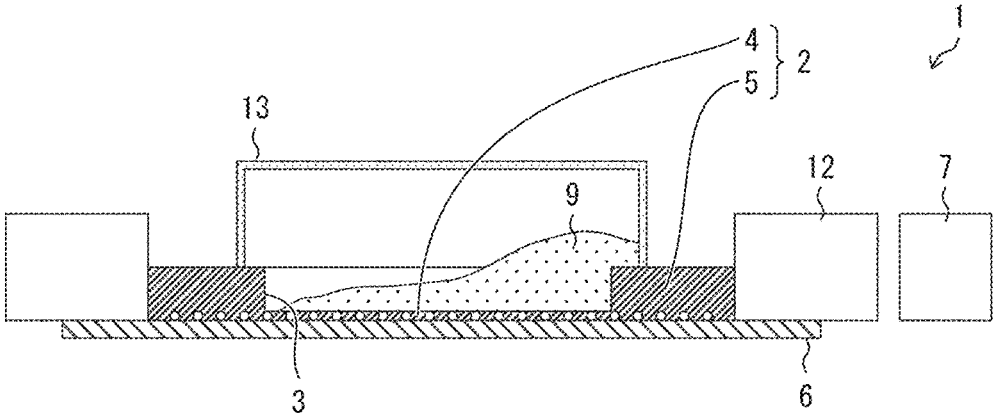

FIG. 7 is a cross-sectional view illustrating a filling step in a powder film forming method in accordance with Embodiment 5.

Figure 8:
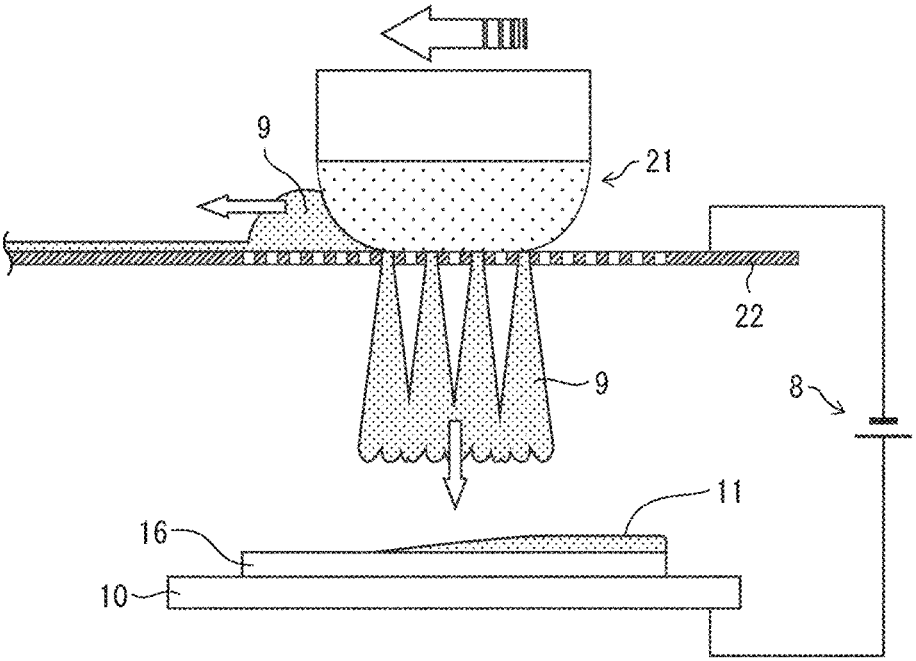

FIG. 8 is a cross-sectional view illustrating a powder film forming method in accordance with Comparative Example.

Figure 9:
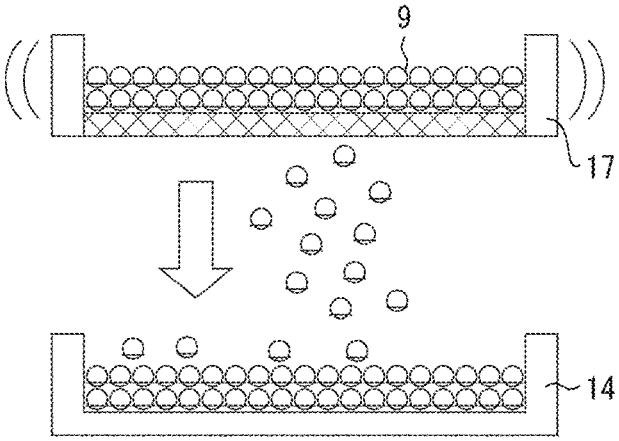

FIG. 9 is a cross-sectional view illustrating a providing step in a powder film forming method in accordance with Embodiment 6.

Figure 10:
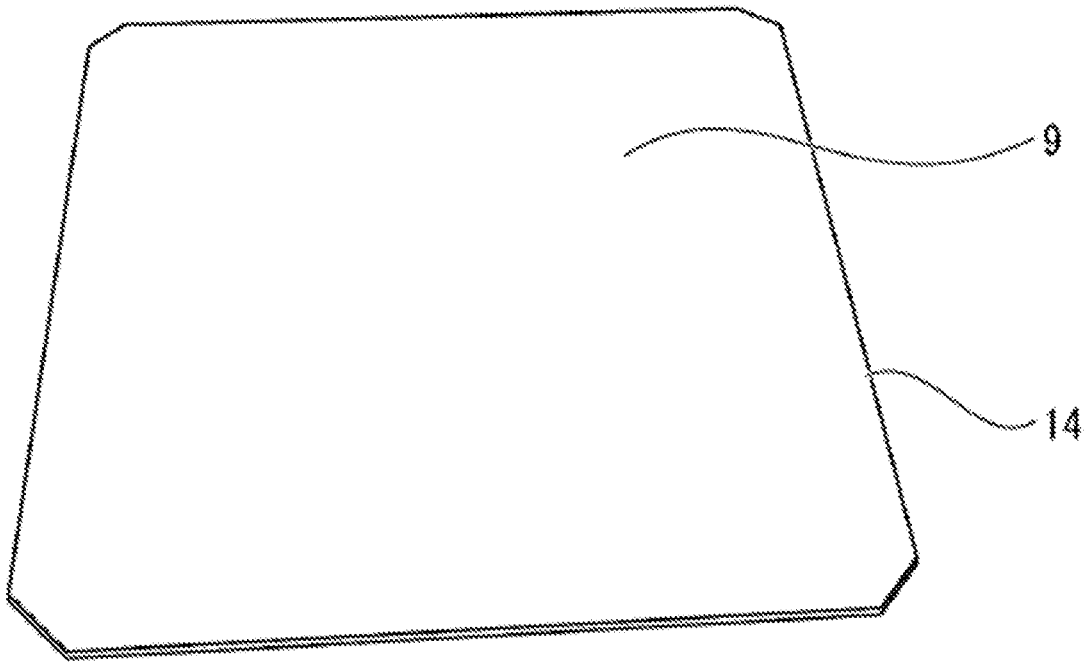

FIG. 10 is a schematic view showing a providing container in which a powder sample is dispersed in the providing step.

Figure 11:
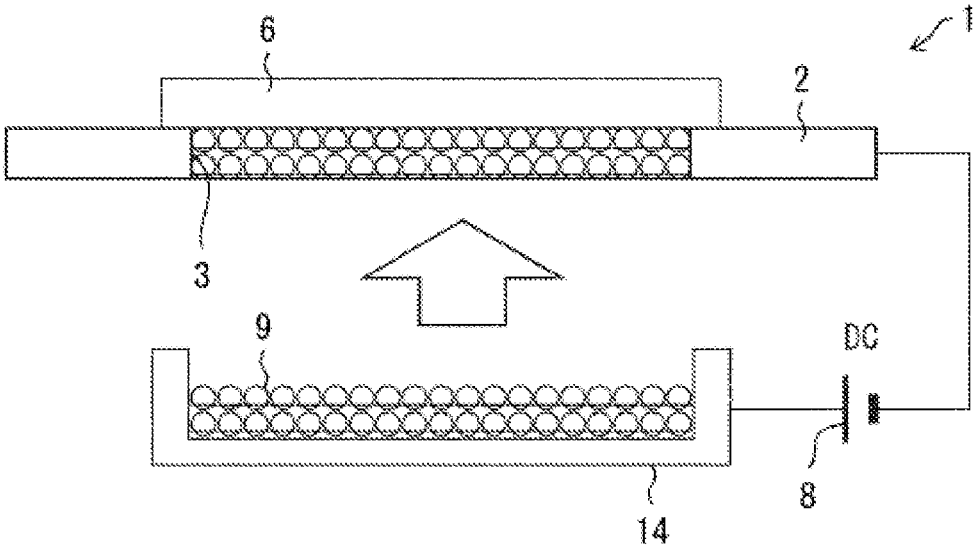

FIG. 11 is a cross-sectional view illustrating a filling step in the powder film forming method.

Figure 12:
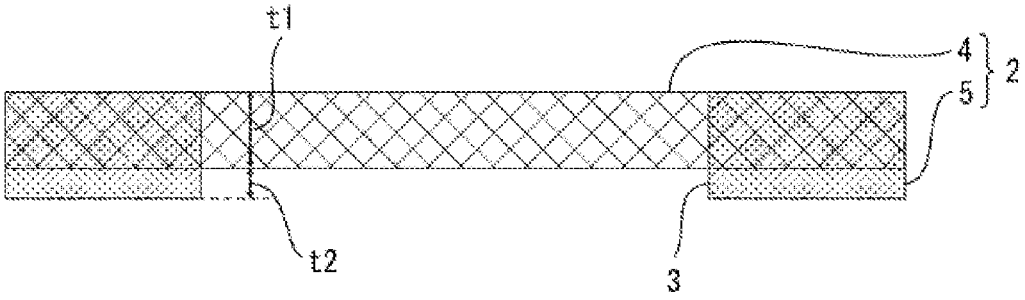

FIG. 12 is a cross-sectional view illustrating a configuration of a screen plate used in the filling step.

Figure 13:
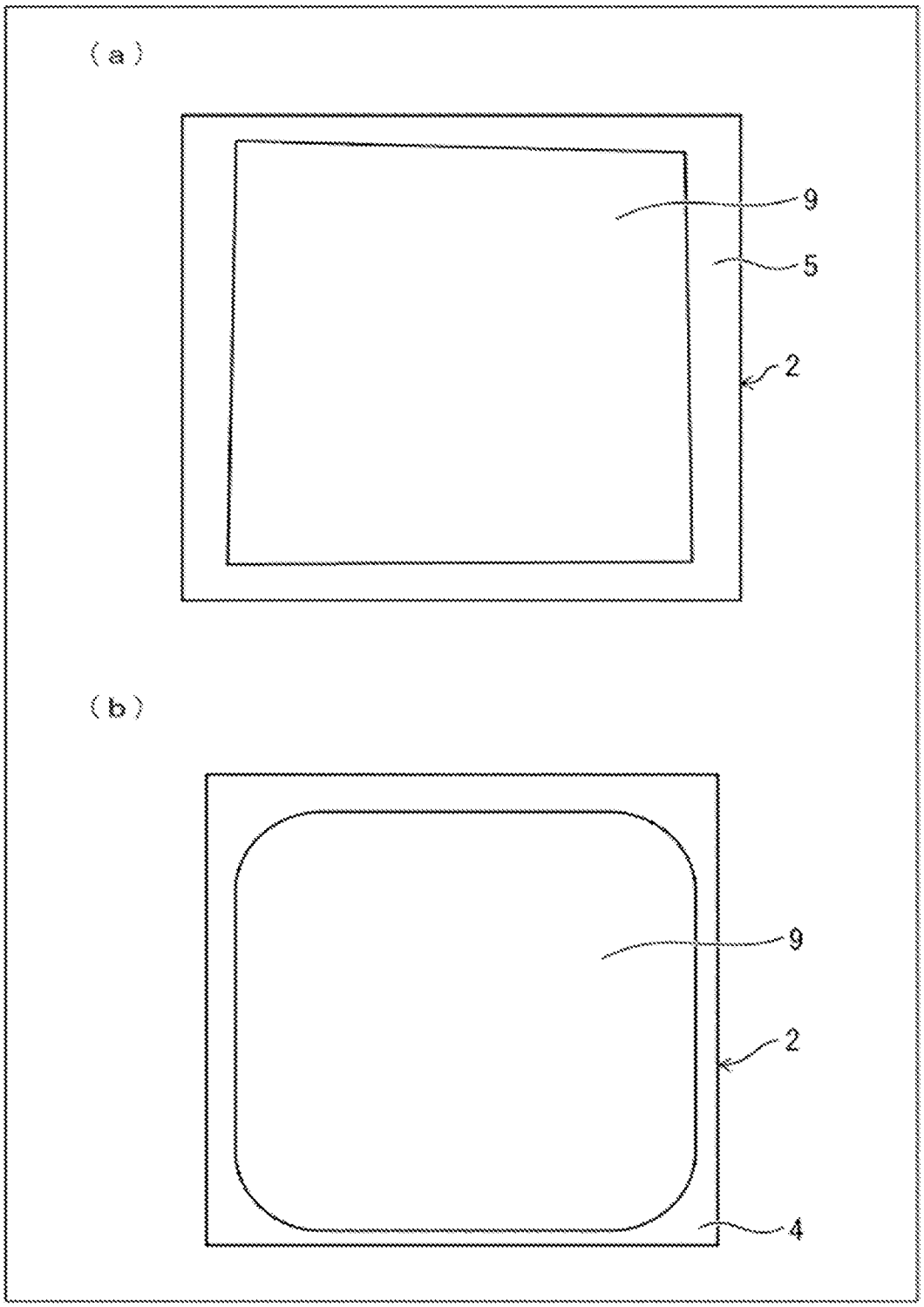

(a) of FIG. 13 is a schematic view in which a screen plate after the filling in the filling step is viewed from an emulsion side. (b) of FIG. 13 is a schematic view in which the screen plate is viewed from a mesh side.

Figure 14:
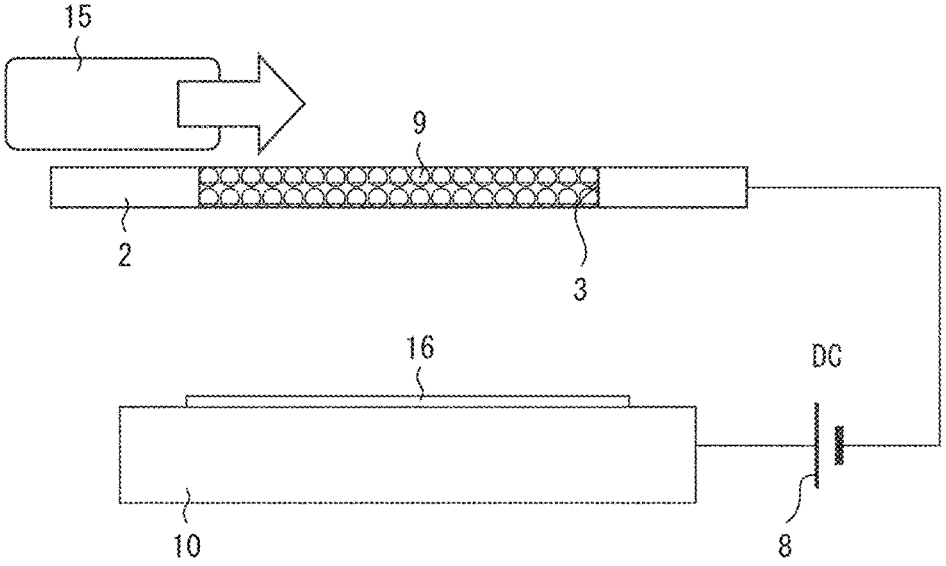

FIG. 14 is a cross-sectional view illustrating a state immediately before rubbing in a film forming step in the powder film forming method.

Figure 15:
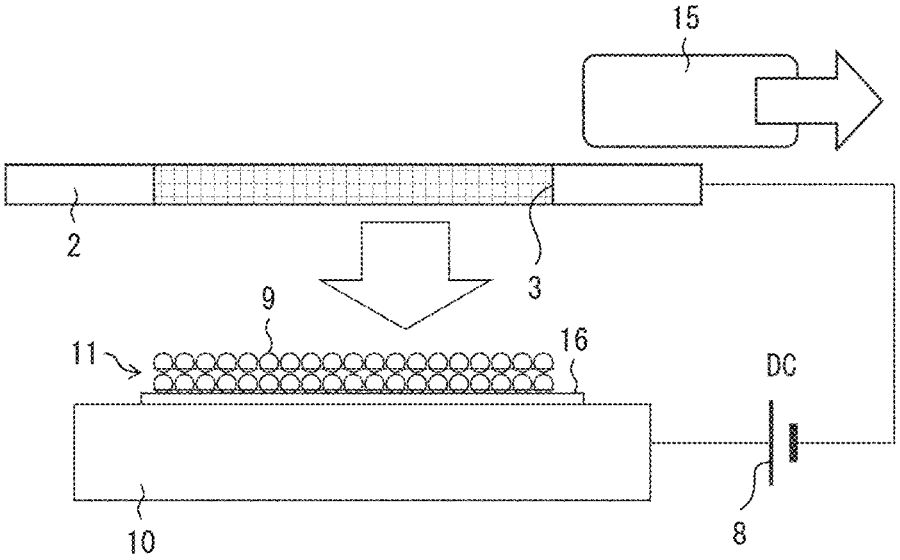

FIG. 15 is a cross-sectional view illustrating how a powder is stuck to a printed material by electrostatic induction in the film forming step.

Figure 16:
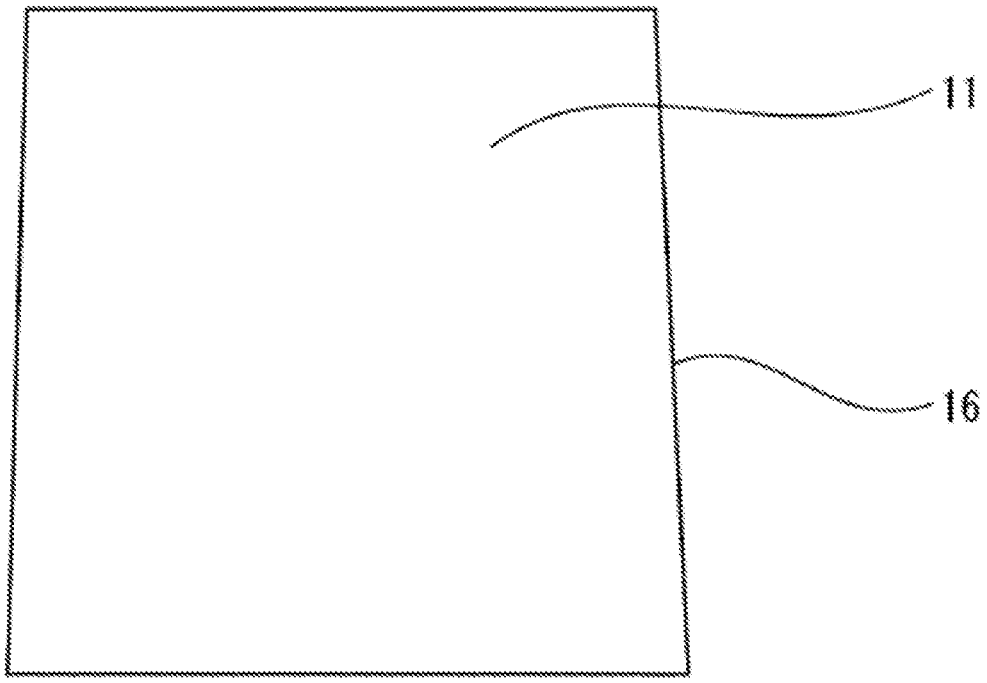

FIG. 16 is a schematic view showing a powder film which has been formed on the printed material in the film forming step.

Figure 17:
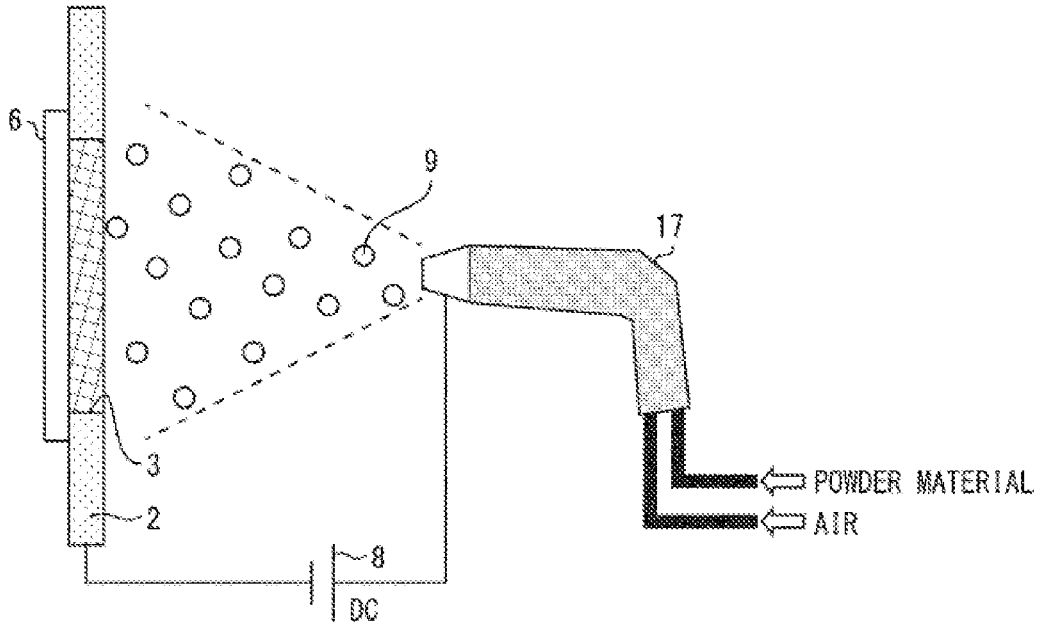

FIG. 17 is a cross-sectional view illustrating a filling step in a powder film forming method in accordance with Embodiment 7.

Figure 18:
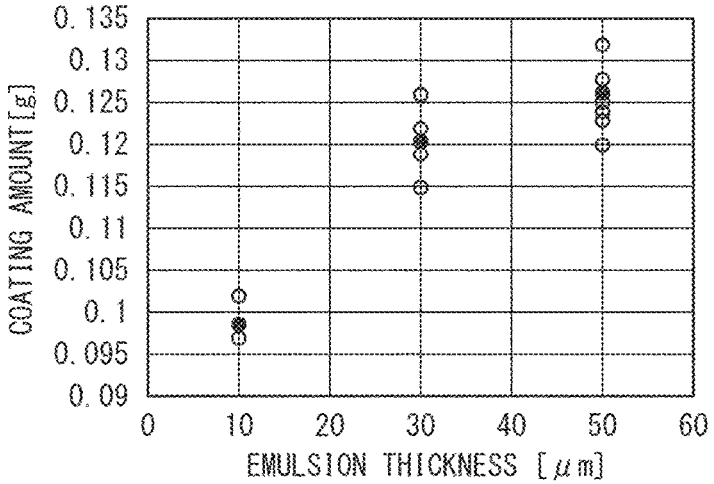

FIG. 18 is a graph showing a relationship between an emulsion thickness and a coating amount when a powder film forming method in accordance with Embodiment 8 is carried out.

Figure 19:
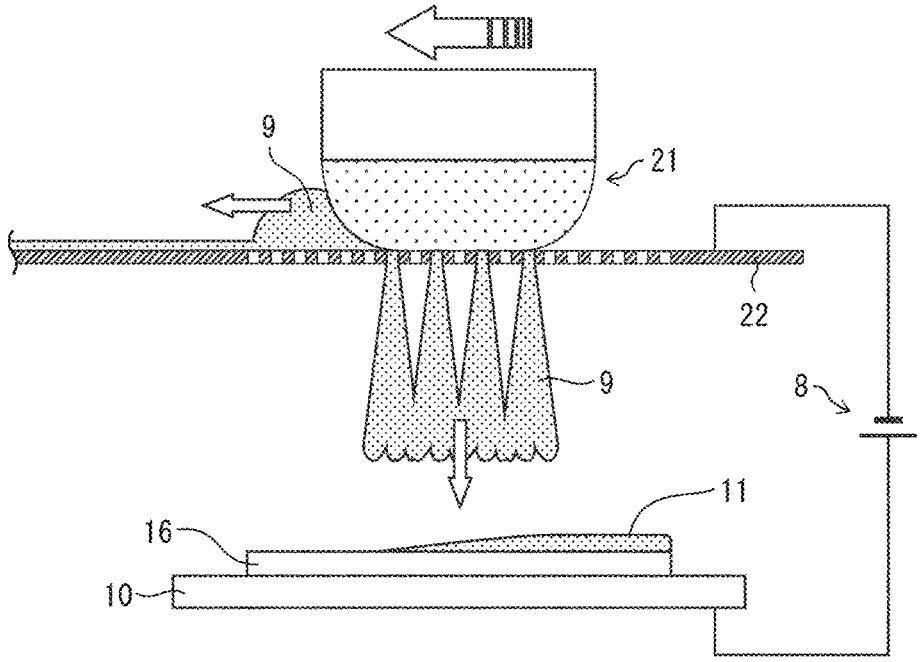

FIG. 19 is a cross-sectional view illustrating a powder film forming method in accordance with Comparative Example.

DESCRIPTION OF EMBODIMENTS

The following description will discuss an embodiment of the present invention in detail.

According to an electrostatic screen printing method, a target object, on which a powder is stuck and accumulated, is not pressured. Therefore, the electrostatic printing method is widely used for target objects, such as food, which may unfortunately be crushed by pressure.

The electrostatic screen printing method is a method in which a powder that is a raw material is accumulated by electrostatic force. The electrostatic screen printing method therefore poses multiple factors which are difficult to be managed to be well reproducible for guaranteeing film thickness accuracy. Examples of the factors encompass (i) a state in which a powder on a screen plate is dispersed and (ii) the number of times a screen brush scans on the screen plate. With the electrostatic screen printing method, therefore, it may unfortunately not be possible to obtain sufficient film thickness accuracy.

For example, according to the conventional technique disclosed in Patent Literature 1 discussed in the Background Art section above, uneven formation occurs to a powder film formed on a substrate from a powder rubbed into a screen with use of a rubbing body. The uneven formation occurs due to (i) a state in which the powder provided on the screen is dispersed and (ii) a track in which the rubbing body moves. This unfortunately causes a film thickness accuracy of the powder film formed with use of the electrostatic film forming device to be insufficient.

Therefore, the inventors of the present invention conducted diligent study to address the problem. As a result, the inventors of the present invention found that sufficient film thickness accuracy can be obtained by (i) filling, with a powder, an opening of a porous body such as a screen plate and (ii) applying the powder, which is thus filling the opening, to a target object through electrostatic force and through rubbing by use of a rubbing body.

The term "fill" as used herein means to (i) block an entirety of an opening by stuffing a powder into the opening and (ii) maintain the blocked state of the opening. Therefore, the term "fill" as used herein does not apply to an aspect in which, for example, a powder simply passes through an opening.

Embodiment 1

A powder film forming method in accordance with an embodiment concerns a production method used for film formation from a powder. More specifically, the powder film forming method in accordance with an embodiment is a dry method of forming a film from a powder. The powder film forming method includes (a) a filling step of filling, with a powder, an opening of a porous body, such as a screen plate or a metal plate, which has been subjected to microfabrication and (b) a film forming step of forming a film on a target object through moving the powder which is filling the opening. In this way, the powder is filling the opening of the porous body so as to have a fixed thickness, and is held by the porous body. By moving the powder to a substrate, it is possible to form a powder film having a fixed thickness. This allows a powder film having good film formation accuracy to be formed.

A filling step in accordance with an embodiment will be described first.

(Filling Step)

Figure 1:
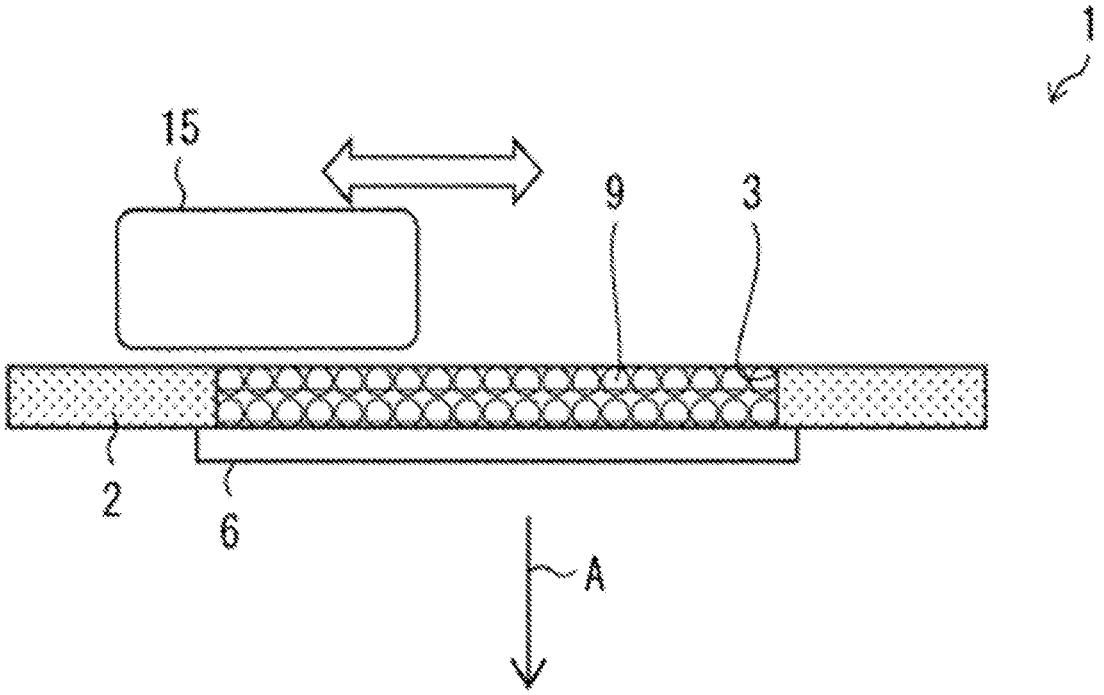
FIG. 1 is a cross-sectional view illustrating a filling step in a powder film forming method in accordance with Embodiment 1.

FIG. 1 is a cross-sectional view illustrating the filling step in a powder film forming method in accordance with Embodiment 1. The powder film forming device 1 includes a screen plate 2 (powder filling member).

Figure 2:
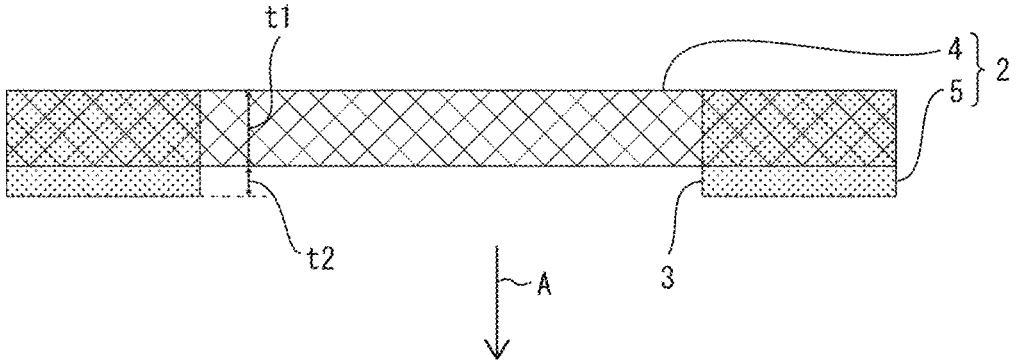
FIG. 2 is a cross-sectional view illustrating a configuration of a screen plate used in the filling step.

FIG. 2 is a cross-sectional view illustrating a configuration of the screen plate 2 used in the filling step. The screen plate 2 includes (i) a screen mesh 4 (porous body) and (ii) a screen emulsion part 5 (covering part) provided on one surface of the screen mesh 4. An opening 3 is formed in the screen emulsion part 5.

The screen plate 2 can be made of typical stainless steel mesh for screen printing. The opening 3 of the screen plate 2 can have, for example, a 50 mm×50 mm square shape. Note, however, that by changing the shape of the opening 3, it is possible to form a powder film 11 into any form.

According to Embodiment 1, the screen mesh 4 of the screen plate 2 has a mesh number of 300/inch, a wire diameter of 30 μm (screen fabric thickness t1=60 μm), and an opening of 55 μm. As illustrated in FIG. 2, the screen plate 2 of Embodiment 1 is formed so that the screen emulsion part 5 extends (i) in a direction from one surface toward the other surface of the screen mesh 4 and (ii) from the other surface. The screen emulsion part 5 is thus formed so as to enter the screen mesh 4 in a direction from the other surface toward the one surface of the screen mesh 4. Hereinafter, the other surface side of the screen mesh 4 will be referred to as "emulsion side", and the one surface side of the screen mesh 4 will be referred to as "mesh side". A thickness t2 of the screen emulsion part 5, by which the screen emulsion part 5 extends from the screen mesh 4, will be referred to as "emulsion thickness". According to Embodiment 1, a volume of a powder 9, with which the opening 3 of the screen plate 2 can be filled, is adjusted by changing the emulsion thickness t2. This controls a formation amount by which the powder film 11 (FIG. 3) is formed on a substrate 10. Note, however, that the volume of the powder 9 can also be adjusted by changing at least one of (i) the screen fabric thickness t1 of the screen mesh 4 and (ii) a mesh size of the screen mesh 4.

The screen plate 2 is provided so that an axis direction (a vertical direction indicated by the arrow A) of the opening 3 aligns with the direction of gravitational force.

On the mesh side of the screen plate 2, a rubbing body 15 made of polyurethane sponge is provided. Instead of the polyurethane sponge, the rubbing body 15 can be made of rubber, squeegee, brush, or the like.

In a case where the opening 3 of the screen plate 2 is filled with the powder 9, the rubbing body 15 moves on the screen mesh 4, so as to rub the powder 9 into the screen mesh 4. This pushes the powder 9 into the opening 3. This allows an entirety of the opening 3 to be uniformly filled with the powder 9.

At the lower side of the opening 3, a holding plate 6 (holding member), which blocks the opening 3 and is smooth, is provided. Then, the powder 9 is provided to the mesh side of the screen plate 2. The powder 9, which has been provided to the mesh side of the screen plate 2, is rubbed into the screen mesh 4 by the rubbing body 15 which is moving on the screen mesh 4 of the screen plate 2. This causes the powder 9 to fill the opening 3 against which the smooth holding plate 6 is pressed from the lower side. Subsequently, the holding plate 6 is removed from the opening 3.

By blocking the opening 3 with use of the holding plate 6, it is possible to prevent the powder 9 filling the opening 3 from falling. In addition, by blocking the opening 3 with use of the holding plate 6, it is possible to cause a lower surface of the powder 9 filling the opening 3 to be smooth. This allows the powder film 11 to be formed more uniformly.

A filling amount of the powder 9 or a formation amount of the powder film 11 can be controlled by (i) a volume of the opening 3 of the screen plate 2 and/or (ii) an amount by which the powder 9 is pushed in (density of the powder). By filling the opening 3 with the powder 9 while the holding plate 6 is pressed against the lower side of the opening 3 of the screen plate 2, a volume of a space filled with the powder 9 is uniquely determined. This (i) allows the powder film 11 to be formed so as to have a desired thickness and (ii) allows a fixed formation amount to be constantly maintained even in a case where film formation is repeated. In addition, in a case where a pressure by which the rubbing body 15 is pressed against the screen mesh 4 during the filling to be fixed, a density of the powder 9 to fill the opening 3 is caused to be fixed. This makes it possible to control the thickness of the powder film 11 to be formed.

The porous body filled with the powder 9 is not limited to the screen plate 2. For example, the porous body can be any of (i) a sieve, (ii) a punching metal, and (iii) a metal plate which is obtained by forming many fine pores in a metal plate. The powder film 11 can be formed into any shape by changing (i) a pattern of the screen emulsion part 5 provided to the screen mesh 4 or (ii) positions of the pores formed in the metal plate. By using the porous body, it is possible to set the formation amount of the powder 9 and the shape of the powder film 11 to any amount and any shape, respectively, and it is also possible to form a powder film 11 having good film thickness accuracy.

According to the powder film forming method in accordance with Embodiment 1, first, a powder 9 is provided on the screen mesh 4 of the screen plate 2. The screen plate 2 can be, for example, a stainless steel mesh, a polyester mesh, or a nylon mesh. According to Embodiment 1, a film can be formed with superior film formation accuracy by forming the film by use of electrostatic induction. It is therefore preferable to use, as the screen plate 2, a stainless steel mesh which is suitable for film formation by electrostatic induction.

In addition, the powder film 11 can be formed into any shape by changing a pattern of the opening 3 of the screen plate 2. In a case where the screen plate 2 is used, it is possible to (i) fill the opening 3 with the powder 9 from the mesh side on which a squeegee is to be scanned during ordinary screen printing or (ii) fill the opening 3 with the powder 9 from the emulsion side.

The formation amount, such as the thickness of the powder film 11 formed, can be controlled by the volume of the opening 3 of the screen plate 2. For example, in a case where the screen plate 2 is used, it is possible to control the volume of the opening 3 by controlling (i) the wire diameter of the screen mesh 4, (ii) the mesh number of the screen mesh 4, and (iii) the emulsion thickness t2. This makes it possible to control the formation amount of the powder film 11. The amount of the powder 9 provided in the opening 3 of the screen plate 2 is not particularly limited, provided that the amount is not less than the volume of the opening 3. From the perspective of uniformly filling the opening 3 of the screen plate 2 with the powder 9, the powder 9 is desirably crushed to such an extent that there are no large agglomerated particles.

Then, the opening 3 of the screen plate 2 is filled with the powder 9 provided on the screen mesh 4 of the screen plate 2. It should be noted that it is important to press the holding plate 6 against the lower side of the opening 3. By thus pressing the holding plate 6, the powder 9, which is filling the opening 3, can be held in the screen plate 2.

A state of a surface of the powder film 11 after being formed depends on a state of an opening 3-side surface of the holding plate 6. Therefore, in order to form the powder film 11 uniformly, it is desirable to (i) cause the thickness of the holding plate 6 to be uniform and (ii) cause unevenness of the opening 3-side surface of the holding plate 6 to be as little as possible.

In contrast, in a case where a distribution in thickness of the powder film 11 is intended, the distribution in thickness of the powder film 11 to be formed can be changed as appropriate by setting a surface-wise distribution in thickness of the holding plate 6. It should be noted that the holding plate 6 can be made of, for example, (i) metal such as stainless steel or (ii) resin. However, in view of smoothness, durability, and the like of the surface, metal is desirable.

While the holding plate 6 is provided at the opening 3, the opening 3 is filled, with use of the rubbing body 15, with the powder 9 provided in the screen mesh 4. The rubbing body 15 can be, for example, (i) a sponge such as a polyurethane sponge, (ii) a squeegee, or (iii) a brush. Then, the rubbing body 15 is scanned across a part of the screen mesh 4, which part is located on the opening 3, so that the powder 9 provided in the screen mesh 4 is pushed into the opening 3. This causes the opening 3 to be filled with the powder 9. In this case, although depending on a surface area of the opening 3, scanning the rubbing body 15 several times completes the process of filling the opening 3 with the powder 9. It is therefore possible to fill the opening 3 with the powder 9 in a short period of time. In addition, it is also possible to control the formation amount of the powder film 11 by controlling (i) the pressure by which the rubbing body 15 pushes the powder 9 into the opening 3 and (ii) the number of times the rubbing body 15 scans.

The film forming step in accordance with an embodiment will be described next.

(Film Forming Step)

Figure 3:
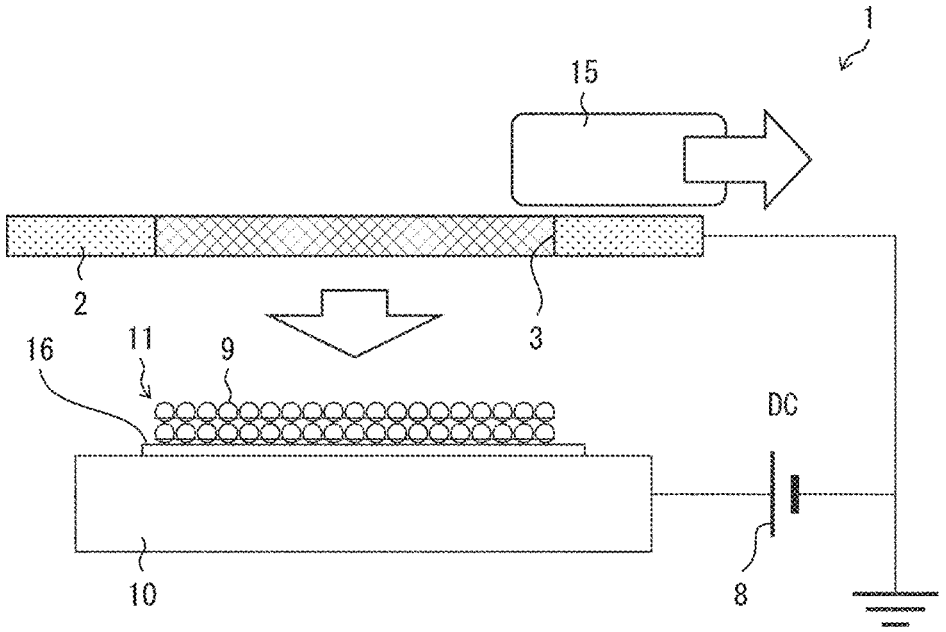
FIG. 3 is a cross-sectional view illustrating a film forming step in the powder film forming method.

FIG. 3 is a cross-sectional view illustrating the film forming step in the powder film forming method. In a case where the powder film 11 is to be formed, there is provided an electric potential difference between the screen plate 2 and the substrate 10. The powder 9 filling the opening 3 moves from the opening 3 to a printed material 16 positioned on the substrate 10, so that the powder film 11 is formed. In this case, the screen plate 2 is connected to a negative electrode of the direct current power supply 8. Then, the powder 9 filling the opening 3 is negatively charged. In this case, the substrate 10 is connected to a positive electrode of the direct current power supply 8.

Then, with use of the rubbing body 15, the powder 9 filling the opening 3 is rubbed from an upper surface of the screen mesh 4. This causes the powder 9 filling the opening 3 to move onto the substrate 10. In this case, the powder 9 is moved, by electrostatic induction, to the substrate 10 while maintaining the shape thereof, such as the thickness, which the powder 9 had when the powder 9 was filling the opening 3. This causes the powder 9 to be stuck onto the surface of the printed material 16 of the substrate 10.

The direct current power supply 8, which connects the screen plate 2 and the substrate 10, can (i) connect the screen plate 2 to the positive electrode and (ii) connect the substrate 10 to the negative electrode.

Depending on the powder 9, there is variance in strength of an electric field which is (i) calculated by a distance and the electric potential difference between the screen plate 2 and the substrate 10 and (ii) necessary for the electrostatic induction. It is therefore important to set a proper strength of the electric field in order to subject the powder 9 filling the opening 3 to the electrostatic induction.

Embodiment 2

A distribution in thickness of a powder film 11 to be formed can be changed as appropriate by changing an in-place thickness of a holding plate 6 which blocks an opening 3 during filling of the opening 3. A holding plate 6A-side surface of a powder 9 filling the opening 3 has a shape obtained by transferring a state of an opening 3-side surface of the holding plate 6. Therefore, in order to cause a distribution in thickness of the powder film 11 to be uniform, it is ordinarily desirable to (i) cause a distribution in thickness of the holding plate 6, which is pressed against the opening 3, to be uniform and (ii) cause unevenness of the opening 3-side surface of the holding plate 6 to be as little as possible.

In contrast, in a case where the distribution in thickness of the powder film 11 is intended, a distribution is provided to the in-place thickness of the holding plate 6 to be pressed against the opening 3. This allows a powder film 11, which has a surface shape with any thickness distribution, to be formed.

(a) of FIG. 4 is a cross-sectional view illustrating the filling step in the powder film forming method in accordance with Embodiment 2. (b) of FIG. 4 is a plan view illustrating the holding plate 6A in accordance with Embodiment 2. Constituent elements, which are identical to those described in Embodiment 1, will be given the same reference signs. The descriptions of these constituent elements will therefore not be repeated.

For example, there are cases where only an end part (peripheral part) of the powder film 11 is intended to be large in thickness. In a case where the powder film 11 has a square shape, a groove is provided only to a part of the holding plate 6A, which part corresponds to the end part of the powder film 11. For example, as illustrated in (a) and (b) of FIG. 4, a groove 17, which has a hollow square shape along an outer peripheral part of the opening 3, is provided in the holding plate 6A. This causes a part of the powder, which part corresponds to the groove 17, to be large in filling amount/thickness when the opening 3 is filled with the powder. Therefore, a part of the powder film 11 to be formed, which part corresponds to the groove 17, to be also large in thickness.

Changing the shape of the groove 17 allows a powder film 11, which has any thickness distribution, to be formed. Note that FIG. 4 shows an example in which a depth of the groove 17 is constant. However, the present invention is not limited to such an example. The depth of the groove 17 can change continuously instead of changing in steps.

Embodiment 3

Embodiments 1 and 2 each discussed an example in which a film is formed by (i) filling the opening 3 with the powder 9 from the screen mesh 4-side of the screen plate 2 and then (ii) moving the powder 9 from the screen emulsion part 5-side of the opening 3 to the substrate 10. However, the present invention is not limited to such an example. Alternatively, it is possible to form a film by (i) filling the opening 3 with the powder 9 from the screen emulsion part 5-side of the screen plate 2 and then (ii) moving the powder 9 from the screen mesh 4-side of the opening 3 to the substrate 10. In such a case, the opening 3 is first filled with the powder 9 from the screen emulsion part 5-side. Subsequently, the screen plate 2 is inverted into the state illustrated in FIG. 2. Then, the rubbing body 15 scans at the screen mesh 4-side so as to cause the powder 9 to move to the substrate 10. This method may improve the film formation accuracy of the powder film 11.

EXAMPLES

The following description will discuss Examples of the present invention with reference to FIGS. 1 through 3.

First, a dry powder, which had a particle size (D50) of 4 μm and a substantially spherical shape, was prepared as a powder 9 to be formed into a film.

In each of Examples 1, 2, and 4 through 6, a screen plate 2 for screen printing was prepared as a porous body which was to be filled with the powder 9. A stainless steel mesh was used as a screen mesh 4. The mesh had a wire diameter of 30 μm, a screen fabric thickness t1 of 60 μm, a mesh number of 300/inch, and an opening of 55 μm. An opening 3 had a solid pattern with a 50 mm×50 mm shape. In Examples, an emulsion thickness was changed as shown in [Table 1] so as to change the volume of the opening 3. [Table 1] shows test conditions and evaluation results of Examples 1 through 6 and of Comparative Example 1.

TABLE 1

| | Test conditions | | | | | | Evaluation result | | |
|---|---|---|---|---|---|---|---|---|---|
| | Filling step Yes/No | Electric field strength (kV/mm) | Porous body | Rubbing body | Screen emulsion thickness (μm) | Pressing plate thickness distribution Yes/No | Single layer formation amount (g) | In-place thickness distribution Yes/No | variance (%) |
| Example 1 | Yes | 0 | Screen plate | Sponge | 50 | No | 0.118 | No | 9.4 |
| Example 2 | Yes | 1 | Screen plate | Sponge | 50 | No | 0.125 | No | 6.7 |
| Example 3 | Yes | 1 | Metal mask | Sponge | 60* | No | 0.101 | No | 8.3 |
| Example 4 | Yes | 1 | Screen plate | Squeegee | 50 | No | 0.120 | No | 7.8 |
| Example 5 | Yes | 1 | Screen plate | Squeegee | 10 | No | 0.104 | No | 6.9 |
| Example 6 | Yes | 1 | Screen plate | Squeegee | 50 | Yes | 0.156 | Yes | 41.1 |
| Comparative Example 1 | No | 1 | Screen plate | Sponge | 50 | — | — | Yes | 30.7 |

In Example 5, a metal mask prepared by electroforming was used. The opening had a solid pattern with a 50 mm×50 mm shape as in the case of the screen plate 2. The opening was caused to have pores corresponding to a mesh number of 300/inch. A metal part had a thickness of 60 μm.

Then, a holding plate 6, which was to be pressed against the opening 3 of the screen plate 2 from the lower side, was prepared. A stainless steel plate used as the holding plate 6 had dimensions of 70 mm×70 mm, a thickness of 300 μm, and a flatness of not more than 50 μm. In Example 6 shown in [Table 1], in particular, a region having dimensions of 40 mm×40 mm likewise had a thickness of 300 μm and a flatness of not more than 50 μm. In parts where the dimensions range from 40 mm to 70 mm, an inclination of 6.7 μm/mm was made from the inner side toward the outer side.

Subsequently, polyurethane sponges and urethane squeegees were prepared as rubbing bodies 15.

Then, powder films 11 were formed according to respective test conditions shown in [Table 1]. In forming of each of the power films 11, a substrate 10 identical to the holding plate 6 was used. The powder 9 filling the opening 3 was moved to the substrate 10, so that the powder film 11 was formed.

In each of Examples 1 through 4 and 6, the formation of was a film was carried out 3 times, so that the powder film 11 including 3 layers was formed. In Example 5, the formation of a film was carried out 5 times, so that the powder film 11 including 5 layers was formed. Note that in order to calculate a formation amount of single layer, the following were measured: (i) a weight of a stainless steel plate of a printed material 16 before the film formation and (ii) a weight of the stainless steel plate of the printed material 16 after the film formation of the single layer. Subsequently, the powder film 11 thus formed was irradiated with light in a horizontal direction, and the presence/absence of a distribution in in-place thickness of the powder film 11 was checked by visual observation.

Then, the powder film 11 thus formed was subjected to pressure molding. A pressure was 10 ton/cm$^2$, and a length of time of the pressuring was 30 seconds. Subsequently, in order to check variance in in-place thickness of the powder film 11 thus pressured, four corners and a center part of the powder film 11 were punched out with use of a hand punch having a diameter of 10 mm, and then respective weights of the four corners and the center part thus punched out were measured. An average value of the weights thus measured was calculated, and then a range of variance as a deviation from the average value was calculated by the unit %. The variances thus calculated are shown in [Table 1].

Comparative Example 1

In Comparative Example 1, a conventional electrostatic film formation, in which no filling step was carried out, was carried out at an electric field strength of 1.0 kV/mm with use of a powder 9, a screen plate 2 and a rubbing body 15 which were similar to those of Example 1. Unlike the method used in Examples 1 through 6, the conventional electrostatic film formation is not a method of forming a powder film having more than one layer. A formation amount of single layer was therefore not measured. Pressure molding of the powder film thus formed, punching out with use of a hand punch, and measurement of a weight were carried out as in Examples 1 through 6.

In Comparative Example 1, the film forming step was not divided into (a) a step of filling the opening of the porous body with a powder and (b) a step of causing the powder, with which the opening of the porous body was filled, to move from the opening to a substrate. This caused an accuracy of an in-place thickness of the powder film formed on the substrate, to be insufficient. Therefore, the value of the variance measured through punching out with use of the hand punch was such a large value as 30.7%.

In contrast, in Example 1, the film forming step was divided into (a) a step of filling the opening 3 of the porous body (screen plate 2) with the powder 9 and (b) a step of causing the powder 9 filling the opening 3 of the screen plate 2 to move from the opening 3 to the substrate 10 so as to form the powder film 11. This caused the value of the variance to be reduced to 9.4% which was approximately ⅓ of that of Comparative Example 1.

In Example 2, when the powder 9 filling the opening 3 of the screen plate 2 was moved from the opening 3 to the substrate 10, an electric potential difference was made so as to generate an electric field strength of 1 kV/mm between the screen plate 2 and the substrate 10. This caused the value of the variance to be more reduced to 6.7%.

In Example 3, the powder film 11 was formed with use of a metal mask as the porous body. As a result of using the metal mask, the volume of the pores of the porous body became less than the volume of the opening 3 of the screen plate 2. Consequently, the formation amount of single layer became less than those of Examples 1 and 2. However, as in Examples 1 and 2, the value of the variance was such a good value as not more than 10%. This confirmed that it is possible to use a metal mask other than the screen plate 2 as a porous body.

In Example 4, as a rubbing body 15, a squeegee was used instead of a sponge. The value of the variance was such a good value as not more than 10%. This confirmed that it is possible to use a rubbing body 15 which is of any of many types other than a sponge.

In Example 5, the volume of the opening 3 of the screen plate 2 as a porous body was decreased by changing the emulsion thickness of the screen plate 2 from 50 μm to 10 μm. As a result, the value of the variance was such a good value as not more than 10%. The formation amount of single layer became less than that of Example 4. This confirmed that it is possible to control the formation amount by controlling the volume of the opening 3 of the screen plate 2.

In Example 6, a distribution in thickness was provided to the holding plate 6 to be pressed against the opening 3 of the screen plate 2. As a result, it was observed that a distribution in in-place thickness occurred to the powder film 11 formed, and the value of the variance was increased. This confirmed that a distribution in in-place thickness of the powder film 11 to be formed can be controlled as appropriate by providing a distribution to the thickness of the holding plate 6.

It should be noted that in each of the examples above, the screen plate 2 including the screen mesh 4 (porous body) and the screen emulsion part 5 (covering part) was used. However, the present invention is not limited to such an example. It is unnecessary to provide a covering part, provided that a desired film thickness can be obtained only with use of a porous body. For example, a member such as an emulsion part of a screen plate is unnecessary in a case where a porous body to be used is obtained by subjecting only a film formation part of a metal plate to a process of forming fine pores. Note, however, that, in a case where a desired film thickness is large, it is preferable to use a screen plate 2 including the screen mesh 4 (porous body) and the screen emulsion part 5 (covering part).

According to the conventional technique disclosed in Patent Literature 2 discussed in the Background Art section above, a powder provided on a screen plate is rubbed into the screen plate by a rubbing body. Therefore, not an entirety of the powder provided on the screen plate is formed into a film on a printed material. Specifically, a powder provided on the screen plate is divided into (i) a powder remaining on the screen plate without being formed into a film on the printed material and (ii) a powder held by the rubbing body. This poses such a problem that it is difficult to control a thickness of a powder film which is formed by causing, by electrostatic induction, a powder to move from a mesh (pores) of the screen plate to a printed material so as to be stuck on the printed material.

The problem is solved as demonstrated in Embodiments 4 and 5 below.

Embodiment 4

(Configuration of Powder Film Forming Device 1)

FIG. 5 is a cross-sectional view illustrating the filling step in a powder film forming method in accordance with Embodiment 4. A powder film forming device 1 includes a screen plate 2 (powder filling member) which is provided in a screen frame 12. The screen plate 2 includes (i) a screen mesh 4 (porous body) and (ii) a screen emulsion part 5 (covering part) provided on one surface of the screen mesh 4. The screen plate 2 is provided so that the screen emulsion part 5 is located at the lower side of the screen mesh 4.

The screen emulsion part 5 has an opening 3. A holding plate 6 (holding member) is provided at the lower side of the screen emulsion part 5 so as to block the opening 3. A powder 9 is provided onto the screen mesh 4. A scattering prevention plate 13, which prevents the powder 9 provided on the screen mesh 4 from scattering, is provided so as to cover the powder 9 and the opening 3.

The powder 9 is, for example, a powder 1 for a JIS test (type 17; heavy calcium carbonate). Note, however, that a powder to be used is not limited to such a powder.

The powder film forming device 1 includes a vibration exciting member 7 configured to subject the screen plate 2 to vibration excitation.

The opening 3 of the screen emulsion part 5 of the screen plate 2 has a square shape. Note, however, that a powder film of any shape can be formed by changing the shape of the opening 3.

The screen mesh 4 has a mesh number of 300/inch, a wire diameter of 30 μm, and an opening size of 55 μm. The screen mesh 4 can be made of a material such as ordinary polyester, ordinary nylon, ordinary stainless steel, or ordinary polyethylene. Note, however, that the mesh number, the wire diameter, the opening size, and the material should be selected according to a powder 9 to be used.

The screen plate 2 can be a porous body which has fine pores in which the powder 9 can be held. Examples of the screen plate 2 encompass a punching metal, a sieve, and a metal plate which has been subjected to microfabrication.

(Powder Film Forming Method)

The powder film forming method in accordance with Embodiment 4 will be described below in the following three steps: (i) a fluidizing step, (ii) a powder filling step (filling step), and (iii) a film forming step.

(Fluidizing Step)

In a case where fluidity of a powder 9 to be used is not good, a fluidization process of improving the fluidity of the powder 9 is carried out first. Note, however, that it is unnecessary to carry out the fluidizing step in a case where the fluidity of the powder 9 is good.

The fluidity of the powder 9 can be improved by a method, example of which encompass: (i) enlarging of a particle diameter of the powder 9 (granulation), (ii) causing a particle diameter distribution to be uniform, (iii) causing each particle to be perfectly spherical, and (iv) removing electricity. The fluidization process in the fluidizing step can be carried out by any one of these methods, or can be carried out by any combination of these methods.

According to Embodiment 4, the fluidization process is carried out by a dry method. Therefore, the granulation of the particles, making of the uniformity of the particle diameter distribution, and slightly making of perfectly spherical particles are carried out by carrying out compression of a raw material, crushing, and sieving in this order.

(Powder Filling Step (Filling Step))

First, a powder 9 is provided on the screen mesh 4 of the screen plate 2. Then, the scattering prevention plate 13 is provided on the screen mesh 4 so as to cover the powder 9 and the opening 3. Then, the vibration exciting member 7 applies vibration to the screen plate 2. This causes the powder 9, which is provided on the screen mesh 4, to (i) pass through the screen mesh 4 due to the vibration applied to the screen plate 2 and (ii) fill the opening 3.

The vibration applied to the screen plate 2 is preferably applied while the holding plate 6 is provided at the lower side of the screen emulsion part 5 so as to cover the opening 3.

In a case where the screen plate 2 is used, vibration is preferably applied to the screen plate 2 while the screen mesh 4 is provided on the upper side the screen emulsion part 5 (see FIG. 5). This causes a lower surface of the powder 9, which is filling the opening 3, to be regulated by the holding plate 6 so as to be flat. Then, an upper surface of the powder 9, which is filling the opening 3, is regulated by the screen mesh 4 so as to be flat. A filling amount of the powder 9, with which the opening 3 is filled, can therefore be precisely controlled by the volume of the opening 3 in the screen plate 2.

Although proper vibration applied to the screen plate 2 varies depending on the powder 9, any typical vibration sieving device can be used as the vibration exciting member 7. Note, however, that in a case where the fluidity of the powder 9 is not good, "in-plane sieving", in which vibration excitation is carried out in a direction along the surface of the screen plate 2, allows the powder 9 to fill the opening 3 more efficiently than in a case of "vibration sieving" in which vibration excitation is carried out in a direction perpendicular to the direction along the surface of the screen plate 2. Depending on the powder 9, it is preferable to carry out vibration excitation by a combination of high-frequency vibration and low-frequency vibration. Note that in a case where (i) a plurality of powder film forming devices 1 illustrated in FIG. 5 are stacked together and (ii) vibration is applied at once to the respective screen plates 2, carrying out the powder filling step a single time allows the plurality of screen plates 2, each of which is filled with a powder 9, to be simultaneously obtained. This makes it possible to shorten a period of time it takes for each screen plate 2 to be filled with the powder 9.

According to Embodiment 4 illustrated in FIG. 5, a typical in-plane sieving device is used as the vibration exciting member 7 to carry out in-plane sieving while the screen plate 2 is inclined by approximately several degrees with respect to the horizontal direction. In this way, the opening 3 of the screen plate 2 is completely filled with the powder 9 in approximately 30 seconds. It can be deemed that in a case where ten powder film forming devices 1 are stacked together and subjected to vibration at once, a period of time it takes for each screen plate 2 to be filled with the powder 9 is approximately 3 seconds.

A film thickness and a powder weight of a powder film 11 to be formed are determined by accuracy with which the opening 3 of the screen plate 2 is filled with the powder 9. Therefore, the powder 9 provided on the screen mesh 4 should, in its entirety, properly fill the opening 3 of the screen plate 2 by optimizing, for example, (i) specifications of the powder 9, (ii) specifications of the screen plate 2, and (iii) vibration conditions.

In a case where the opening 3 of the screen plate 2 cannot be completely filled with the powder 9 because, for example, part of the powder 9 forms a lump, it is desirable to remove an excess powder before proceeding to the film forming step to be carried out next. Note that the term "lump" means an aggregate formed as a result of the powder 9 rolling over the screen plate 2. In a case where a diameter of the aggregate is larger than the mesh size of the screen mesh 4, the aggregate cannot pass through the screen mesh 4. Consequently, the aggregate becomes an excess powder (i.e., an unwanted powder which cannot fill the opening irrespective of the number of times of vibration).

(Film Forming Step)

FIG. 6 is a cross-sectional view illustrating the film forming step in the powder film forming method. In a case where the vibration exciting member 7 applies vibration to the screen plate 2 in which the opening 3 is filled with the powder 9, the powder 9 filling the opening 3 falls. This causes a powder film 11 to be formed on the substrate 10.

In the film forming step, the screen plate 2 is preferably provided so that the screen emulsion part 5 is positioned at the lower side of the screen mesh 4. This allows the powder 9, which is filling the opening 3 of the screen plate 2, to easily fall on the substrate 10 provided below the opening 3.

In the film forming step, while it is unnecessary to use the holding plate 6 used in the powder filling step, the scattering prevention plate 13 can be used as necessary. In order to make it unnecessary to use the scattering prevention plate 13, however, it is preferable to find vibration conditions under which the powder 9 filling the opening 3 of the screen plate 2 is prevented from passing through the screen mesh 4 so as to be scattered upwards.

The vibration applied to the screen plate 2 in the film forming step can be smaller in vibration exciting force than the vibration applied to the screen plate 2 in the powder filling step. Although the vibration applied in the film forming step varies depending on the specifications of the powder 9 and on the specifications of the screen plate 2, it is necessary to apply ultrasonic vibration, low-frequency vibration, or one-time impact vibration.

Even in a case where the vibration exciting member 7 merely applies vibration to the screen plate 2 in which the opening 3 is filled with the powder 9, the powder 9 falls on the substrate 10 provided at the lower side of the screen plate 2. This allows the powder film 11 to be formed. Note, however, that in order to improve film formation accuracy, the powder 9 is preferably attracted to the substrate 10 by an electrostatic force which is generated between the screen plate 2 and the substrate 10 through providing a direct current power supply 8 that causes an electric potential difference between the screen plate 2 and the substrate 10. According to Embodiment 4, a distance and an electric potential difference between the screen plate 2 and the substrate 10 are approximately 10 mm and 8 kV, respectively. However, the present invention is not limited to such an example. This is because proper conditions vary depending on the specifications of the powder 9 and on the specifications of the screen plate 2.

In a case where the powder 9 and the screen plate 2 in accordance with Embodiment 4 are used, formation of the powder film 11 on the substrate 10 is completed merely by applying slight impact vibration once to the screen plate 2 while the electric potential difference is made between the screen plate 2 and the substrate 10. This allows the film forming step to be completed within 3 seconds per screen plate 2.

Embodiment 5

(Powder Filling Step)

FIG. 7 is a cross-sectional view illustrating a filling step in a powder film forming method in accordance with Embodiment 5. Constituent elements, which are identical to those described with reference to FIG. 5, will be given the same reference signs. The detailed descriptions of these constituent elements will therefore not be repeated.

The filling step differs from the filling step in the powder film forming method describe with reference to FIG. 5 in that the screen plate 2 illustrated in FIG. 5 is turned upside down so that the screen mesh 4 is located below the screen emulsion part 5.

In a case where a powder 9 is provided on the screen emulsion part 5 and then a vibration exciting member 7 subjects the screen plate 2 to vibration excitation, the powder 9 vibrates so as to fill an opening 3.

The screen plate 2 is preferably subjected to vibration excitation while a holding plate 6 is provided at the lower side of the screen mesh 4. However, in a case where the screen mesh 4 can reliably hold the powder 9, it is unnecessary to provide the holding plate 6. In a case where the powder 9 is excessively scattered as a result of the vibration, it is possible to prevent the scattering of the powder 9 by providing a scattering prevention plate 13 so that the scattering prevention plate 13 covers the powder 9.

In a case where the screen mesh 4 is provided on the upper side of the screen emulsion part 5 as illustrated in FIG. 5, the powder 9 needs to pass through the screen mesh 4. Therefore, there may be a case where the opening 3 cannot be filled favorably, depending on the powder 9. In such a case, as illustrated in FIG. 7, the screen plate 2 is inverted and the opening 3 is filled with the powder 9. This allows the opening 3 to be filled favorably with any of most types of powders 9. However, in a case where the screen plate 2 is thus inverted, it is necessary to carry out the following after the opening 3 is filled with the powder 9. That is, it is necessary to cause an upper surface of the powder 9 filling the opening 3 to be as flat as possible by removing, through leveling the powder 9 filling the opening 3, an excess powder which is remaining without filling the opening 3.

Comparative Example

FIG. 8 is a cross-sectional view illustrating a powder film forming method in accordance with Comparative Example. The powder film forming method in accordance with Comparative Example is a typical electrostatic screen printing method. First, a powder 9 is rubbed, with use of a rubbing member 21, into a screen 22 which is connected to a negative electrode of a direct current power supply 8 or to ground (earth). This causes the powder 9 to come into contact with the screen 22 so as to be charged or grounded. The powder 9 thus charged or grounded is, due to electrostatic induction, stuck to a printed material 16 on a substrate 10 which is connected to a positive electrode of the direct current power supply 8. This causes a powder film 11 to be formed. Alternatively, it is possible that (i) the screen 22 is connected to the positive electrode of the direct current power supply 8 and (ii) the substrate 10 is connected to the positive electrode of the direct current power supply 8.

In Comparative Example described above, particles of the powder 9, which are in contact with the screen 22, are charged or grounded so as to be firmly stuck to the printed material 16. However, neither particles, which are not in contact with the screen 22, nor a group of particles, which are assembled on the screen 22 so as to be a bulk, are charged or grounded favorably. Such particles of the powder 9, which are not charged or grounded, may be subjected to rubbed against the rubbing member 21 and/or screen 22 so as to be frictionally charged, so that electric charge of the powder 9 may become non-uniform. This unfortunately causes the particles and the particle group, which are not charged favorably, to result in impairment of film formation accuracy of a powder film 11.

According to Embodiments 4 and 5, a powder film is formed on the substrate 10 by causing the powder 9 filling the opening 3 of the screen plate 2 to vibrate so as to move to the substrate 10. Therefore, the particles of the powder 9 do not necessarily need to be charged. In addition, the particles of the powder 9 in the screen mesh 4, which are charged or grounded, are charged or grounded directly by the screen mesh 4 or via other particles of the powder 9 which are charged or grounded. Therefore, impairment of the film formation accuracy of the powder film 11, which occurs due to the particles or the particle group which are not charged favorably, is prevented from occurring.

In addition, to such particles and such a particle group which are not charged favorably, an attraction force toward the printed material 16 by electrostatic induction is not sufficiently applied. This also causes such a problem that the mesh (pores) of the screen 22 is clogged with the particles and the particle group, so as to lead to failure of formation of the powder film 11.

According to Embodiments 4 and 5, a powder film is formed on the substrate 10 by causing the powder 9 filling the opening 3 of the screen plate 2 to vibrate so as to move to the substrate 10. Therefore, the particles of the powder 9 do not necessarily need to be charged. Therefore, the failure of the formation of the powder film 11, which occurs because the mesh (pores) of the screen 22 is clogged with the particles or the particle group, is prevented from occurring.

In addition, in Comparative Example described above, ideally all of the powder particles are dropped onto the printed material 16 positioned below the screen 22 while the powder particles are in contact with the mesh of the screen 22 so as to be charged favorably. However, in a case where a large amount of powder particles is provided to the mesh (pores) of the screen 22 at once, it is difficult to cause all of the powder particles to come into contact with the mesh of the screen 22. It is therefore not possible to provide a large amount of powder particles at once to the mesh (pores) of the screen 22. This unfortunately poses such a problem that it takes a long period of time to form the powder film 11. For example, in Comparative Example described above, a period of approximately 10 minutes (approximately 600 seconds) is necessary for forming a powder film having dimensions of 100 mm×100 mm and a thickness of 100 μm.

According to Embodiments 4 and 5, a powder film is formed on the substrate 10 by causing the powder 9 filling the opening 3 of the screen plate 2 to vibrate so as to move to the substrate 10. This makes it unnecessary to cause all of powder particles to be charged favorably by coming into contact with the screen mesh. It is therefore possible to shorten a period of time it takes to form the powder film 11.

Table 2 shows the results of film formation in Comparative Example and Embodiment 4, each with the aim of forming a film having dimensions of 100 mm×100 mm and a thickness of 100 μm.

TABLE 2

| Example results | | | | | | | | |
|---|---|---|---|---|---|---|---|---|
| | Average thickness (μm) | Maximum film thickness (μm) | Minimum film thickness (μm) | Thickness difference (μm) | Standard deviation (μm) | Standard deviation/ Average thickness (%) | Film formation time (sec) | Contamination |
| Comparative Example | 105 | 154 | 87 | 67 | 36 | 34.3 | 600 | Yes |
| Embodiment 1 | 104 | 121 | 92 | 29 | 19 | 18.3 | 3 | No |

In comparison with Comparative Example, Embodiment 4 brings about the following advantages: (i) there is no risk of contamination due to abrasion or the like by the rubbing member 21, (ii) a period of time for film formation is shorter, and (iii) it is easy to control the thickness of a film to be formed and control the weight of a powder. This allows a large amount of powder film to be stably formed in a short period of time.

It should be noted that in each of the examples above, the screen plate 2 including the screen mesh 4 (porous body) and the screen emulsion part 5 (covering part) was used. However, the present invention is not limited to such an example. It is unnecessary to provide a covering part, provided that a desired film thickness can be obtained only with use of a porous body. For example, a member such as an emulsion part of a screen plate is unnecessary in a case where a porous body to be used is obtained by subjecting only a film formation part of a metal plate to a process of forming fine pores. Note, however, that, in a case where a desired film thickness is large, it is preferable to use a screen plate 2 including the screen mesh 4 (porous body) and the screen emulsion part 5 (covering part).

According to the conventional technique disclosed in Patent Literature 2 discussed in the Background Art section above, the rubbing body such as a sponge moves on a powder which has been provided on the screen plate. This causes the powder to pass through the screen mesh and the opening of the screen plate so as to be applied to the substrate, so that a powder film is formed. Therefore, uneven formation of a powder film occurs due to (i) a state in which the powder is dispersed on the screen plate and (ii) a track in which the rubbing body moves on the screen plate. Hence, it was unfortunately not possible to form a powder film with sufficient film thickness accuracy in the technical field requiring uniformity of films formed.

In addition, according to the conventional technique of Patent Literature 2 described above, ideally all of powder particles are dropped onto the printed material positioned below the screen plate while the powder particles are in contact with the mesh of the screen plate so as to be charged favorably. However, in a case where a large amount of powder particles is provided to the mesh (pores) of the screen plate at once, it is difficult to cause all of the powder particles to come into contact with the mesh of the screen plate. It is therefore not possible to provide a large amount of powder particles at once to the mesh (pores) of the screen plate. This unfortunately poses such a problem that it takes a long period of time to form the powder film.

The problem is solved as demonstrated in Embodiments 6 through 8 below.

Embodiment 6

According to a powder film forming method in accordance with Embodiment 6, a conventional electrostatic screen printing method is improved so as to be able to form, in a short period of time, a thin film of a powder, a thickness of which thin film is more uniform.

Embodiment 6 includes: a providing step of providing a crushed powder at a lower side of a screen plate having a porous body; a filling step of filling, by an electrostatic force, an opening of the screen plate with the powder provided below the screen plate; and a film forming step of forming a powder film by causing, by an electrostatic force, the powder to move from the opening of the screen plate, which is filled with the powder, to a substrate so that the powder is stuck onto the substrate.

In particular, the principle of an electrostatic force is used also in the filling step so as to fill the opening of the screen plate with a powder.

The porous body can be any of (i) a screen mesh, (ii) a sieve, (iii) a punching metal, and (iv) a member which is obtained by forming many fine pores in any of other metal plates. A powder film of any shape can be formed by changing a factor(s), examples of which encompass (i) the shape of any of these members and (ii) positions of the pores to be formed.

Each step in the powder film forming method in accordance with Embodiment 6 will be described below.

(Providing Step)

FIG. 9 is a cross-sectional view illustrating the providing step in the powder film forming method in accordance with Embodiment 6. First, a powder 9 is crushed and dispersed in a providing container 14. The powder 9 is not particularly limited, provided that the powder 9 is crushed to such an extent that particles of the powder 9 are not aggregated together.

For example, as illustrated in FIG. 9, there is a method in which the powder 9 is crushed with use of a sieve 17 provided at the upper side of the providing container 14, so that the powder 9 is provided into the providing container 14. The powder 9 is sieved through the sieve 17 so as to be dropped and dispersed into the providing container 14 having a bottom surface which is made of an electrically conducive material such as metal.

In this case, it is unnecessary for the powder 9 to be exactly uniformly dispersed into the providing container 14, provided that the powder 9 in an amount larger than the volume of an opening 3 of a screen plate 2 illustrated in FIGS. 11 and 12 in the filling step (described later) is dispersed all over the bottom surface of the providing container 14 so that the bottom surface of the providing container 14 is not exposed.

Therefore, the method of crushing the powder 9 so as to provide the powder 9 into the providing container 14 is not limited to a method in which the sieve 17 is used. Examples of the method encompass generally conceivable methods such as (i) a method in which the powder 9 is provided through ultrasonic sieving, (ii) a method in which the powder 9 is provided through spray coating, (iii) a method in which the powder 9 is provided with use of a coater feeder, and (iv) a combination of these methods. In addition, the powder 9 can be crushed by use of air stream or centrifugal force. The providing container 14 can be a flat plate.

The powder 9 can be a dry powder having a particle size (D50) of 5 μm. Note, however, that the powder 9 used in the powder film forming method in accordance with Embodiment 6 is not limited to such an example.

The sieve 17 can be a sieve having (i) an inner diameter φ of 75 of JIS Z-8801 and (ii) a mesh size of 500 μm. Note, however, that the sieve 17 is not limited to such an example. In addition, the crushing method is not limited to a method in which the sieve 17 is used. It is necessary to select a proper crushing method according to the powder 9.

FIG. 10 is a schematic view showing the providing container 14 in which the powder 9 is dispersed in the providing step. The providing container 14 was a flat plate which had a 70 mm×70 mm square shape and which was made of SUS (stainless steel). The powder 9 was dispersed onto the SUS flat plate while the powder 9 was being crushed by the sieve 17. It is unnecessary for the powder 9 thus crushed to be exactly uniformly dispersed, provided that the powder 9 dispersed in such an amount that the bottom surface of the SUS flat plate is not exposed (0.50 g to 0.55 g).

(Filling Step)

FIG. 11 is a cross-sectional view illustrating the filling step in the powder film forming method. A powder film forming device 1 includes the screen plate 2 (powder filling member) having the opening 3 which is to be filled with the powder 9.

FIG. 12 is a cross-sectional view illustrating a configuration of the screen plate 2 used in the filling step. The screen plate 2 includes (i) a screen mesh 4 (porous body) and (ii) a screen emulsion part 5 (covering part) provided on one surface of the screen mesh 4. The opening 3 is formed in the screen emulsion part 5.

The screen plate 2 can be made of typical stainless steel mesh for screen printing. The opening 3 of the screen plate 2 can have a 50 mm×50 mm square shape. Note, however, that by changing the shape of the opening 3, it is possible to form a powder film 11 into any form.

According to Embodiment 6, the screen mesh 4 of the screen plate 2 has a mesh number of 300/inch, a wire diameter of 30 μm (screen fabric thickness t1=60 μm), and an opening of 55 μm. As illustrated in FIG. 12, the screen plate 2 of Embodiment 6 is formed so that the screen emulsion part 5 extends (i) in a direction from one surface toward the other surface of the screen mesh 4 and (ii) from the other surface. Hereinafter, the other surface side of the screen mesh 4 will be referred to as "emulsion side", and the one surface side of the screen mesh 4 will be referred to as "mesh side". A thickness t2 of the screen emulsion part 5, by which the screen emulsion part 5 extends from the screen mesh 4, will be referred to as "emulsion thickness". According to Embodiment 6, the volume of the powder 9, with which the opening 3 of the screen plate 2 can be filled, is adjusted by changing the emulsion thickness t2. This controls a formation amount by which the powder film 11 (FIG. 15) is formed on a substrate 10. Note, however, that the volume of the powder 9 can also be adjusted by changing at least one of (i) the screen fabric thickness t1 of the screen mesh 4 and (ii) a mesh size of the screen mesh 4.

Then, in the providing step, the providing container 14, in which the powder 9 is dispersed, is provided below the screen plate 2. Then, a holding plate 6 (holding member) for blocking the upper surface side of the opening 3 is provided on the screen plate 2. Subsequently, a positive electrode of a direct current power supply 8 (power supply), which has a negative electrode connected to the screen plate 2, is connected the providing container 14.

Consequently, the powder 9 on the providing container 14 is positively charged by the positive electrode of the direct current power supply 8. Then, the powder 9, which is positively charged, is attracted, by electrostatic induction, to the screen plate 2 which is negatively charged by the negative electrode of the direct current power supply 8. Then, the opening 3 of the screen plate 2 is filled with the powder 9. Needless to say, positive and negative of the direct current power supply 8 can be inverted so as to (i) connect the positive electrode of the direct current power supply 8 to the screen plate 2 and (ii) connect the negative electrode to the providing container 14.

An electric field strength (electric potential difference, distance) between the providing container 14 and the screen plate 2 is necessary for attracting the powder 9, by electrostatic induction, from the providing container 14 to the screen plate 2. The electric field strength varies depending on the type of the powder 9. Therefore, the electric field strength (electric potential difference, distance) should be set to a proper value according to each type of the powder 9.

(a) of FIG. 13 is a schematic view in which the screen plate 2 after the filling in the filling step is viewed from the emulsion side. (b) of FIG. 13 is a schematic view in which the screen plate 2 is viewed from the mesh side. According to Embodiment 6, as illustrated in FIG. 11, the providing container 14 (which is an SUS plate onto which the powder 9 is provided) is provided below the screen plate 2 on which the holding plate 6 (which is an SUS plate) is provided. According to Embodiment 6, the screen plate 2 is provided so that the mesh side and the emulsion side face upwards and downwards, respectively. The emulsion thickness t2 of the screen plate 2 is set to 50 μm.

Then, the holding plate 6 is provided on the emulsion side of the screen plate 2. A distance of 7 mm is set between (i) the screen plate 2 and (ii) the providing container 14 (which is an SUS plate onto which the powder 9 is provided). The screen plate 2 is grounded. To the providing container 14 which is an SUS plate, a voltage of 8 kV is applied. The strength of the electric field between the screen plate 2 and the providing container 14 which is an SUS plate is 1.14 kV/mm. This causes the powder 9 to be moved, by an electrostatic force based on the electric field strength, from the providing container 14 (which is an SUS plate) to the opening 3 formed in the screen emulsion part 5 of the screen plate 2 so as to fill the opening 3 (see FIGS. 11 and 13).

Note that in the filling step, the opening 3 can be filled with the powder 9 by, with use of an electrostatic spray discussed in Embodiment 7 (described later), spraying the opening 3, to which the voltage is applied, with the powder 9 which is charged.

The description above discussed an example in which the opening 3 is filled with the powder 9 from the lower surface side of the opening 3. However, the present invention is not limited to such an example. Alternatively, it is possible to fill the opening 3 with the powder 9 from the upper surface side of the opening 3.

(Film Forming Step)

FIG. 14 is a cross-sectional view illustrating a state immediately before rubbing in the film forming step in the powder film forming method. FIG. 15 is a cross-sectional view illustrating how the powder 9 is stuck to the printed material 16 by electrostatic induction in the film forming step.

As illustrated in FIG. 14, the screen plate 2, in which the opening 3 is filled with the powder 9 in the filling step, is connected to the negative electrode of the direct current power supply 8. This causes the powder 9 filling the opening 3 to be negatively charged by contact charging. Then, the substrate 10, on which the printed material 16 is provided, is connected to the positive electrode of the direct current power supply 8. Then, the powder 9 filling the opening 3 of the screen plate 2 is rubbed off from the opening 3 of the screen plate 2 with use of the rubbing body 15 which moves on the screen plate 2.

Consequently, as illustrated in FIG. 15, the powder 9 is moved, by electrostatic induction, from the opening 3 to the printed material 16 so as to be stuck to the printed material 16, while the powder 9 maintains its thickness the powder 9 had when the powder 9 was filling the opening 3. This causes a powder film 11 to be formed. Needless to say, as in the filling step described earlier, positive and negative of the direct current power supply 8 can be inverted so as to (i) connect the positive electrode of the direct current power supply 8 to the screen plate 2 and (ii) connect the negative electrode to the providing container 14.

A greater electric field strength (electric potential difference) between the printed material 16 and the screen plate 2 causes the powder 9 to be stuck more firmly to the printed material 16. This makes it possible to cause a density of a powder film 11 to be higher by increasing the electric field strength. The electric field strength (electric potential difference, distance) between the printed material 16 and the screen plate 2 is necessary for attracting the powder 9, by electrostatic induction, from the screen plate 2 to the printed material 16. Note, however, that as in the filling step described earlier, the electric field strength varies depending on a charging property or the like of the powder 9. Therefore, the electric field strength (electric potential difference, distance) should be set to a proper value according to the charging property or the like of the powder 9.

Voltages applied in the filling step and in the film forming step can be applied by a completely identical method. In each case, the application of a voltage can be carried out by (i) connecting the screen plate 2 to earth (GND) (i.e., grounding the screen plate 2) or applying a negative voltage to the screen plate 2 or (ii) applying a positive voltage to the substrate 10 or to the providing container 14. Note, however, that between the filling step and the film forming step, there are differences in terms of (i) the value of voltages to be applied and (ii) a distance between the screen plate 2 and the substrate 10 or the providing container 14. Needless to say, positive and negative of the direct current power supply 8 can be inverted so as to (i) connect the positive electrode of the direct current power supply 8 to the screen plate 2 and (ii) connect the negative electrode to the providing container 14.

In a case where the voltage is applied to the screen plate 2, the powder 9, which is filling the opening 3 of the screen plate 2 so as to be in contact with the opening 3, is charged. Therefore, in a case where the electric potential difference is generated between the screen plate 2 and the substrate 10 by the direct current power supply 8, the following simultaneously occurs: (i) the charging of the powder 9 and (ii) the generation of an electrostatic field between the screen plate 2 and the substrate 10.

Basically, the formation of an electrostatic field between the screen plate 2 and the substrate 10 should be all it takes to cause, the powder 9 filling the opening 3 to be attracted, by an electrostatic force, to the substrate 10. However, the following phenomenon is conceivable. That is, the powder 9 filling the opening 3 is not necessarily moved favorably to the substrate 10 only by an electrostatic force because a force by which the powder 9 is stuck to the screen plate 2 is greater than the electrostatic force applied to the powder 9. In view of the foregoing, it is possible to move the powder 9 favorably to the substrate 10 by (i) causing the rubbing body 15, which moves on the screen plate 2, to rub the powder 9 off from the opening 3 of the screen plate 2 or (ii) applying vibration to the screen plate 2.

It is possible to form a powder film 11 on the substrate 10 merely by causing the powder 9 filling the opening 3 to fall without using an electrostatic force. However, by use of an electrostatic force, it is possible to form a powder film 11 which is densely formed so as to be durable. In addition, in a case where the powder 9 filling the opening 3 is caused to fall by use of an electrostatic force, the powder 9 falls vertically toward the substrate 10 without being scattered. This allows a powder film 11, which has a uniform thickness, to be formed.

FIG. 16 is a schematic view showing a powder film 11 which has been formed on the printed material 16 in the film forming step. The printed material 16, which has a 70 mm×70 mm square shape and which is an SUS plate, is provided below the screen plate 2 in which the opening 3 is filled with the powder 9. The screen plate 2 is inverted from the orientation thereof in the filling step, and is provided so that the emulsion side is below the mesh side. A distance between the screen plate 2 and the printed material 16 (SUS plate) is set to 6 mm. The screen plate 2 is connected to earth (i.e., grounded). To the printed material 16 which is an SUS plate, a voltage of 8 kV is applied. An electric field strength between the screen plate 2 and the printed material 16 (which is an SUS plate) is 1.33 kV/mm. In this state, the rubbing body 15 made of sponge rubs on the screen mesh 4 of the screen plate 2 several times so as to cause the powder 9 filling the opening 3 to move to the printed material 16 (SUS plate). This causes a powder film 11 to be formed on the printed material 16 as illustrated in FIG. 16. Note that the rubbing body 15 can be made of a material other than sponge. Examples of such a material encompass rubber, squeegee, and brush.

Table 3 shows relationships between amounts of powders 9 provided and corresponding formation amounts of powder films 11 formed in eight respective tests conducted under conditions similar to those described above.

TABLE 3

| Test No. | 1 | 3 | 4 | 5 | 6 | 7 | 8 | Ave | STD | STD (%) |
|---|---|---|---|---|---|---|---|---|---|---|
| Providing amount | 0.515 g | 0.512 g | 0.507 g | 0.503 g | 0.525 g | 0.531 g | 0.529 g | 0.5174 g | 0.0102 g | 2.0% |
| Formation amount | 0.128 g | 0.120 g | 0.124 g | 0.123 g | 0.125 g | 0.132 g | 0.132 g | 0.1263 g | 0.0042 g | 3.4% |

(Effects)

The description above discussed the series of steps involved in Embodiment 6. With the configuration of Embodiment 6, a larger volume of the opening 3 formed in the screen plate 2 allows for (i) a larger filling amount of powder 9 to fill the opening 3 or (ii) a larger formation amount of powder film 11 to be formed from the powder 9 filling the opening 3. For example, the filling amount or the formation amount can be controlled by (i) the thickness of the screen emulsion part 5 of the screen plate 2 and (ii) the mesh size of the screen mesh 4.

According to Embodiment 6, it is also possible to further form a film so that the film is stacked on a powder film 11 formed on the printed material 16. Therefore, the formation amount of powder films can be controlled by forming films any number of times.

Furthermore, on a powder film 11 formed on the printed material 16, a powder film of a different type can be formed. This makes it possible to form a thin film in which a plurality of powder films of different types are stacked.

Embodiment 7

FIG. 17 is a cross-sectional view illustrating the filling step in a powder film forming method in accordance with Embodiment 7. According to Embodiment 6, the providing container 14, in which a powder 9 is dispersed, is provided at the lower side of the opening 3 of the screen plate 2, and the powder 9 thus dispersed in the providing container 14 is charged by generating an electric potential difference between the screen plate 2 and the providing container 14. This causes the opening 3 to be filled with the powder 9 thus charged. However, the present invention is not limited to such an example.

An opening 3 can be filled with a powder 9, which is charged, by spraying the opening 3 with the powder 9 with use of an electrostatic spray 17. To the opening 3, a voltage can be applied.

The electrostatic spray 17 is provided so as to face the opening 3 of a screen plate 2. Then, the electrostatic spray 17 is connected to a positive electrode of a direct current power supply 8. The screen plate 2 is connected to a negative electrode of the direct current power supply 8. To the electrostatic spray 17, the powder 9 and air are provided.

The powder 9, which has been thus provided to the electrostatic spray 17, is positively charged. This causes the powder 9 to be sprayed by air from the electrostatic spray 17 toward the opening 3 of the screen plate 2 which is negatively charged. Then, the opening 3 is filled with the powder 9. Alternatively, it is possible to (i) connect the electrostatic spray 17 to the negative electrode of the direct current power supply 8 and (ii) connect the screen plate 2 to the positive electrode.

The electrostatic spray 17 can fill the opening 3 of the screen plate 2 with the powder 9 from the lower side of the opening 3. Alternatively, the electrostatic spray 17 can fill the opening 3 with the powder 9 from the upper side of the opening 3. FIG. 17 shows an example in which the opening 3 is filled with the powder 9 from the lower side of the opening 3.

In the example of FIG. 17, the screen plate 2 and the electrostatic spray 17 are connected to each other via the direct current power supply 8. This generates an electric potential difference between the screen plate 2 and the electrostatic spray 17 in the filling step. However, the present invention is not limited to such an example. In the filling step in which the electrostatic spray 17 is used, the opening 3 can be physically sprayed with the powder 9 which is charged. It is not necessarily necessary to generate an electric potential difference between the screen plate 2 and the electrostatic spray 17.

Embodiment 8

FIG. 18 is a graph showing a relationship between an emulsion thickness and a coating amount when a powder film forming method in accordance with Embodiment 8 is carried out. In Embodiment 8, comparisons were made between different formation amounts of powder films 11 formed by a method similar to the method of Embodiment 6, under the following respective three conditions: (i) the emulsion thickness t2 of a screen plate 2 was 50 μm, (ii) the emulsion thickness t2 of a screen plate 2 was 10 μm, and (iii) the emulsion thickness t2 of a screen plate 2 was 30 μm.

The horizontal axis indicates the emulsion thickness t2 of the screen plate 2, and the vertical axis indicates the formation amount (coating amount) of the powder film 11. Each of the black circles in FIG. 18 indicates an average value of formation amounts corresponding to emulsion thicknesses indicated by the corresponding white circles. The results reveal that a greater emulsion thickness t2 (volume of the opening 3) of the screen plate 2 leads to a greater formation amount (coating amount) of a powder film 11.

(Effect)

With the configuration of Embodiment 8, it is possible to control a formation amount (coating amount) of a powder film 11 by adjusting the emulsion thickness t2 of the screen plate 2.

Comparative Example

FIG. 19 is a cross-sectional view illustrating a powder film forming method in accordance with Comparative Example. The powder film forming method in accordance with Comparative Example is a typical electrostatic screen printing method.

First, a powder 9 is rubbed, with use of a rubbing body 21, into a screen 22 which is connected to a negative electrode of a direct current power supply 8. This causes the powder 9 to come into contact with the screen 22 so as to be charged. The powder 9 thus charged is, due to electrostatic induction, stuck to a printed material 16 on a substrate 10 which is connected to a positive electrode of the direct current power supply 8. This causes a powder film 11 to be formed. Needless to say, it is possible that (i) the screen 22 is connected to the positive electrode of the direct current power supply 8 and (ii) the substrate 10 is connected to the negative electrode of the direct current power supply 8.

However, the powder 9 may be retained in a certain part of the screen 22, depending on (i) a state in which the powder 9 is dispersed on the screen 22 and (ii) a manner in which the rubbing body 21 for rubbing the powder 9 into the screen 22 moves on the screen 22. Then, a greater amount of powder 9 retained leads to a greater amount of powder 9 falling below the screen 22. This unfortunately leads to an uneven thickness of a powder film 11 to be formed on the printed material 16.

According to each of Embodiments 6 through 8, a smooth state of the powder 9 filling the opening 3 of the screen plate 2 is reflected in a powder film 11 to be formed on the substrate 10. This allows a thin film having a uniform thickness to be formed without being affected by (i) the state in which the powder 9 is dispersed or (ii) the manner in which the rubbing body 21 moves.

In addition, according to Comparative Example, it is not possible to provide a large amount of powder 9 at once into the opening 3 of the screen 22. This unfortunately results in a long period of time for forming a film.

Then, as a result of the abrasion of the rubbing body 21 due to the long period of time it takes for the formation of a film, contamination into the powder film 11 may unfortunately occur because of the abrasion of the rubbing body 21.

According to each of Embodiments 6 through 8, a target to be rubbed by the rubbing body 15 is a powder 9 which is filling the opening 3 of the screen plate 2. Therefore, the powder 9 filling the opening 3 can be caused to fall onto the substrate 10 merely by causing the rubbing body 15 to rub on the screen plate 2 several times. This, in comparison with Comparative Example, allows for (i) a considerable reduction in the period of time for formation of a film and (ii) a decrease in amount of contamination which occurs due to the abrasion of the rubbing body 21.

In the filling step in each of Embodiments 6 through 8, the powder 9 is, by an electrostatic force, attracted to the opening 3 of the screen plate 2 so as to fill the opening 3 without contact. Therefore, contamination into the powder 9 filling the opening 3, which contamination occurs because of the abrasion of the rubbing body 21, is prevented from occurring. In addition, a period of time for filling the opening 3 with the powder 9 by an electrostatic force is such a short period as approximately several seconds. This prevents an entire period of time for formation of a film from becoming long even in a case where the process is divided into the filling step and the film forming step.

Unlike Comparative Example in which a powder 9 dispersed on the screen 22 is moved onto the substrate 10 via the screen 22, Embodiments 6 through 8 are each carried out so that, while one surface-side of the opening 3 of the screen plate 2 is blocked by the holding plate 6 which is smooth, a powder 9 is attracted by an electrostatic force to the other surface-side of the opening 3 of the screen plate 2 so as to fill the opening 3. Then, the opening 3 is detached from the holding plate 6, and the powder 9 filling the opening 3 is moved onto the printed material 16 by an electrostatic force and by the rubbing body 15. This allows a powder film 11 having a uniform thickness to be formed. In particular, an electrostatic force is used for filling the opening 3 of the screen plate 2 with the powder 9.

TABLE 4

| | Total formation amount (50 × 50 square) | φ10 average Formation amount | Margin of error (+) | Margin of error (−) | Variation (range) | σ | 3σ/AVE |
|---|---|---|---|---|---|---|---|
| Comparative Example | 0.4170 g | 0.0275 g | 0.0030 g | 0.0031 g | 22.15% | 0.0025 g | 27.03% |
| Embodiment 2 (3-layer stack) | 0.3090 g | 0.0237 g | 0.0004 g | 0.0002 g | 2.53% | 0.0002 g | 2.84% |

By referring to weight variances within powder film surfaces, a comparison was made between (i) film formation accuracy of a powder film formed by the powder film forming method in accordance with Comparative Example and (ii) film formation accuracy of a powder film formed by the powder film forming method in accordance with Embodiment 7. The four corners and a center part (i.e., the total of five parts) of a powder film, which has been pressure-molded with a pressure of 10 ton/cm$^2$, was punched out with use of a punch press having a diameter of 10 mm. Then, by measuring the weights of the respective five punched-out parts of the powder film, weight variance within a powder film surface was obtained. The emulsion thickness t2 of the screen plate 2 used for forming the powder film in accordance with Embodiment 7 was 10 μm. For pressure-molding a powder film, it is necessary for the powder film to have a thickness to a certain extent. Therefore, a powder film, in which three layers were stacked, was used as the powder film in accordance with Embodiment 7. Table 4 shows the results of the measurement. It was found that in Embodiment 7, the weight variance within a powder film surface was considerably improved from 22.15% to 2.53%.

Periods of time required for respective steps in formation of a film by an electrostatic filling method were measured for Embodiment 6 and for Comparative Example (conventional method).

The period of time measured in each step excludes a period of time required for preliminary preparation such as (i) measuring the weight of a powder 9 and (ii) arrangement of the providing container 14. In the providing step, a period of time from the start of the dispersion with use of the sieve 17 until the end of the dispersion was measured. In the filling step, a period of time from the start of the application of voltage until the end of the filling was measured. In the film forming step, a period of time from the start of the application of voltage until the end of the film formation was measured. Table 5 shows the results of the measurement.

TABLE 5

| | Embodiment 1 | Conventional method |
|---|---|---|
| Providing step (providing material) | 15 sec | 5 sec |
| Filling step | 1 sec | 0 sec |
| Film forming step | 5 sec | 90 sec |
| Total | 21 sec | 95 sec |

The results of the measurement confirmed that in comparison with Comparative Example, Embodiment 6 shortened a total amount of time required for forming a single film, from 95 seconds to 21 seconds (i.e., by 74 seconds). In addition, takt time for building a production line (i.e., a period of time required for a step for which it took the longest period of time among all the steps) was (i) 15 seconds in the case of the electrostatic filling method of Embodiment 6, which was required for the providing step and (ii) 90 seconds in the case of Comparative Example, which was required for the film forming step. This shows that in comparison with Comparative Example, Embodiment 6 shortened the takt time by 75 seconds. Note that the providing step in accordance with Embodiment 6, the takt time can be further shortened by applying a dispersion method other than the dispersion method in which the sieve 17 is used.

It should be noted that in each of the examples above, the screen plate 2 including the screen mesh 4 (porous body) and the screen emulsion part 5 (covering part) was used. However, the present invention is not limited to such an example. It is unnecessary to provide a covering part, provided that a desired film thickness can be obtained only with use of a porous body. For example, a member such as an emulsion part of a screen plate is unnecessary in a case where a porous body to be used is obtained by subjecting only a film formation part of a metal plate to a process of forming fine pores. Note, however, that, in a case where a desired film thickness is large, it is preferable to use a screen plate 2 including the screen mesh 4 (porous body) and the screen emulsion part 5 (covering part).

(Recap)

As has been described, a powder film forming method in accordance with an embodiment is a method of forming a powder film, including the steps of: (a) filling an opening 3 with a powder 9, the opening 3 being formed in a powder filling member (screen plate 2); and (b) forming the powder film 11 by generating an electric potential difference between the powder filling member (screen plate 2) and a substrate 10 so as to cause the powder 9, which is filling the opening 3, to move to the substrate 10.

According to the arrangement, the opening of the powder filling member is filled, by the rubbing body, with the powder having a fixed thickness. Then, due to an electric potential difference between the powder filling member and the substrate, the powder moves to the substrate, so as to form a powder film having the fixed thickness. This allows a powder film to be formed with good film thickness accuracy.

The powder film forming method is preferably arranged so that in the step (a), the powder 9 is rubbed by a rubbing body 15 so as to fill the opening 3.

With the arrangement, it is possible to efficiently fill the opening with the powder.

The powder film forming method is preferably arranged so that in the step (a), the powder 9 is vibrated so as to fill the opening 3.

With the arrangement, it is possible to fill the opening 3 with the powder by use of a simple arrangement.

The powder film forming method is preferably arranged so that in the step (a), the powder 9 to fill the opening 3 is charged.

With the arrangement, it is possible to reliably fill the opening with the powder.

The powder film forming method is preferably arranged so that in the step (a), the powder 9, which is charged, is caused to fill the powder filling member (screen plate 2) by spraying with use of an electrostatic spray 17.

With the arrangement, it is possible to reliably fill the opening with the powder.

The powder film forming method is preferably arranged so that in the step (b), the powder 9 is rubbed by a rubbing body 15 so as to move to the substrate 10.

With the arrangement, it is possible to efficiently move the powder to the substrate.

The powder film forming method is preferably arranged so that in the step (b), the powder 9 is vibrated so as to move to the substrate 10.

With the arrangement, it is possible to move the powder to the substrate by use of a simple arrangement.

The powder film forming method is preferably arranged so that: the powder filling member (screen plate 2) includes a porous body (screen mesh 4) and a covering part (screen emulsion part 5) provided on one surface of the porous body (screen mesh 4); the covering part (screen emulsion part 5) has the opening 3; and in the step (b), the covering part (screen emulsion part 5) is provided on a side facing the substrate 10.

With the arrangement, it is possible to configure the powder filling member with use of a typical screen plate.

As has been described, a powder film forming device 1 in accordance with an embodiment includes: a powder filling member (screen plate 2) having an opening 3 to be filled with a powder 9; a rubbing body 15 configured to rub the powder 9 into the opening 3 from one end side of the opening 3 so as to fill the opening 3 with the powder 9; and a power supply (direct current power supply 8) configured to generate an electric potential difference between the powder filling member (screen plate 2) and a substrate 10 so as to cause the powder 9, which is filling the opening 3, to move to the substrate 10.

The powder film forming device 1 is preferably arranged so as to further include: a vibration exciting section (vibration exciting member 7) configured to subject the powder filling member (screen plate 2) to vibration excitation.

The powder film forming device 1 is preferably arranged so as to further include: an electrostatic spray 17 configured to fill the opening 3 with the powder 9.

As has been described, a powder film forming method in accordance with an embodiment is a method of forming a powder film, including the steps of: (a) filling an opening 3 with a powder 9 by vibrating the powder 9, the opening 3 being formed in a powder filling member (screen plate 2); and (b) forming the powder film 11 by causing the powder 9, which is filling the opening 3, to move to the substrate 10.

The powder film forming method is preferably arranged so that in the step (b), the powder 9 is rubbed by a rubbing body 15 so as to move to the substrate 10.

The powder film forming method is preferably arranged so that in the step (b), the powder 9 is vibrated so as to move to the substrate 10.

The powder film forming method is preferably arranged so that: the powder filling member (screen plate 2) includes a porous body (screen mesh 4) and a covering part (screen emulsion part 5) provided on one surface of the porous body (screen mesh 4); the covering part (screen emulsion part 5) has the opening 3; and in the step (b), the covering part (screen emulsion part 5) is provided on a side facing the substrate 10.

(Recap-1)

As has been described, the powder film forming method in accordance with Embodiment 1 includes the steps of: (a) filling, through rubbing by the rubbing body 15, an opening 3 with a powder 9, the opening 3 being formed in a powder filling member (screen plate 2); and (b) forming the powder film 11, on the substrate 10, by generating an electric potential difference between the powder filling member (screen plate 2) and a substrate 10 so as to cause the powder 9, which is filling the opening 3, to move to the substrate 10.

According to the arrangement, the opening of the powder filling member is filled, by the rubbing body, with the powder having a fixed thickness. Then, the powder moves to the substrate, so as to form a powder film having the fixed thickness. This allows a powder film to be formed with good film thickness accuracy.

The powder film forming method is preferably arranged so that: in the step (a), (i) the holding member (holding plate 6) for blocking the opening 3 is provided on the lower side of the opening 3, (ii) the opening 3 is filled with the powder 9 from the upper side, and then (iii) the holding member (holding plate 6) is removed; and in the step (b), the substrate 10 is provided below the opening 3, and the powder 9 filling the opening 3 is moved from the lower side of the opening 3 to the substrate 10.

According to the arrangement, the holding member for blocking the opening is provided at the lower side of the opening, and the opening is filled with the powder from the upper side. By blocking the opening with use of the holding plate, it is possible to cause a surface of the powder filling the opening to be smooth. This allows the powder film to be more uniformly formed by causing the powder to move from the opening to the substrate.

The powder film forming method is preferably arranged so that: the powder filling member (screen plate 2) includes a porous body (screen mesh 4) and a covering part (screen emulsion part 5) provided on one surface side of the porous body (screen mesh 4); and the covering part (screen emulsion part 5) has the opening 3.

With the arrangement, a typical screen plate can be used as the powder filling member.

The powder film forming method can be arranged so that: the power film 11 is formed on the substrate 10 by (i) filling the opening 3 with the powder 9 from the covering part (screen emulsion part 5) side of the powder filling member (screen plate 2) which is provided so that the covering part (screen emulsion part 5) is positioned on the upper side of the porous body (screen mesh 4), (ii) inverting the powder filling member (screen plate 2), and (iii) causing the powder 9, which is filling the opening 3, to move from the covering part (screen emulsion part 5) side to the substrate 10.

With the arrangement, film formation accuracy is further improved.

The powder film forming device in accordance with Embodiment 1 includes: the powder filling member (screen plate 2) in which the opening 3 to be filled with the powder 9 is formed; the rubbing body 15 configured to rub the powder 9 into the one end side of the opening 3 so as to fill the opening 3 with the powder 9; the holding member (holding plate 6) provided so as to be able to block the other end side of the opening 3; and the power supply (direct current power supply 8) configured to generate an electric potential difference between the powder filling member (screen plate 2) and the substrate 10 in order to form a powder film 11 on the substrate 10 by causing the powder 9, which is filling the opening 3, to move to the substrate 10.

(Recap-2)

As has been described, the powder film forming method in accordance with each of Embodiments 4 and 5 is a method of forming a powder film, including the steps of: (a) filling an opening 3 with a powder 9 by vibrating the powder 9, the opening 3 being formed in a powder filling member (screen plate 2); and (b) forming, on a substrate 10, the powder film 11 by causing the powder 9, which is filling the opening 3, to move to the substrate 10.

According to the arrangement, the powder film 11 is formed on the substrate 10 by causing the powder 9, which is filling the opening 3 of the powder filling member (screen plate 2), to move to the substrate 10. This causes a smooth thickness state of the powder 9, which is filling the opening 3, to be reflected in a powder film 11 to be formed. Therefore, in comparison with the conventional configuration in which a powder on the screen 22 passes through the opening 3 to move to the substrate 10 as a result of the rubbing member 21 moving on the screen 22, it is possible to cause the thickness of the powder film 11, which is to be formed on the substrate 10, to be closer to being uniform.

The powder film forming method can be arranged so that in the step (b), the powder 9 filling the opening 3 is vibrated so as to move to the substrate 10.

With the arrangement, it is possible, by providing a vibration exciting member, to cause the powder 9 to move to the substrate 10.

The powder film forming method can be arranged so that in the step (b), the powder 9 is caused to move to the substrate 10 by applying a voltage between the powder filling member (screen plate 2) and the substrate 10.

With the arrangement, it is possible, by providing a direct current power supply, to cause the powder 9 to move to the substrate 10.

The powder film forming method can be arranged so that: the powder filling member (screen plate 2) includes a porous body (screen mesh 4) and a covering part (screen emulsion part 5) provided on one surface of the porous body (screen mesh 4); and the covering part (screen emulsion part 5) has the opening 3.

With the arrangement, it is possible to configure the powder filling member with use of a typical screen plate.

The powder film forming method in accordance with Embodiment 4 can be arranged so that: in the step (a), the opening 3 is filled with the powder 9 via the porous body (screen mesh 4) while (i) the covering part (screen emulsion part 5) is provided at a vertically lower side and (ii) the holding member (holding plate 6) is provided so as to block a vertically lower side of the opening 3 of the covering part (screen emulsion part 5).

According to the arrangement, (i) the bottom surface of the powder 9 filling the opening 3 is caused by the holding plate 6 to be flat and (ii) the upper surface of the powder 9 is caused by the screen mesh 4 to be flat. This allows the filling amount of the powder 9 to be suitably controlled by the volume of the opening 3.

The powder film forming method in accordance with each of Embodiments 4 and 5 can be arranged so that before the step (a), at least one of the following steps is carried out: (i) the step of granulation of the powder 9, (ii) the step of causing each particle of the powder 9 to be perfectly spherical, and (iii) the step of causing a particle diameter distribution to be uniform.

With the arrangement, it is possible to increase the fluidity of the powder 9 which is filling the opening 3 of the screen plate 2.

(Recap-3)

As has been described, the powder film forming method in accordance with each of Embodiments 6 through 8 includes the steps of: (a) filling an opening 3 with a powder 9 which has been charged, the opening 3 being formed in a powder filling member (screen plate 2); and (b) forming the powder film 11, on the substrate 10, by generating an electric potential difference between the powder filling member (screen plate 2) and a substrate 10 so as to cause the powder 9, which is filling the opening 3, to move to the substrate 10.

According to the arrangement, the powder 9 filling the opening 3 moves to the substrate 10 due to an electric potential difference between the powder filling member (screen plate 2) and the substrate 10. This causes a powder film 11 to be formed on the substrate 10. This causes a smooth thickness state of the powder 9, which is filling the opening 3, to be reflected in a powder film 11 to be formed. Therefore, in comparison with the conventional configuration in which a powder on the screen 22 passes through the opening 3 to move to the substrate 10 as a result of the rubbing body 21 moving on the screen 22, it is possible to cause the thickness of the powder film 11, which is to be formed on the substrate 10, to be closer to being uniform. In addition, due to the electric potential difference, the powder 9 filling the opening 3 moves to the substrate 10 all at once. It is therefore possible to shorten a period of time it takes to form a powder film.

The powder film forming method can be arranged so that in the step (a), the providing container 14, in which the powder 9 is dispersed, is provided at the lower side of the opening 3, and the powder 9 thus dispersed in the providing container 14 is charged by generating an electric potential difference between the powder filling member (screen plate 2) and the providing container 14, so that the opening 3 is filled with the powder 9 thus charged.

With the arrangement, it is possible, by use of a simple arrangement, to fill the opening 3 with the powder 9 from the lower side of the opening 3.

The powder film forming method can be arranged so that in the step (a), the powder 9, which is charged, is sprayed by the electrostatic spray 17 to the opening 3 to which a voltage is applied, so that the opening 3 is filled with the powder 9 which is charged.

With the arrangement, it is possible to fill the opening 3 with the powder 9 by use of such a simple arrangement as the electrostatic spray 17.

The powder film forming method can be arranged so that in the step (a), (i) the holding member (holding plate 6) for blocking the upper surface of the opening 3 is provided and (ii) the opening 3 is filled with the powder 9 from the lower surface side.

With the arrangement, it is possible, by use of the holding member (holding plate 6), to secure a smooth state of the powder 9 which is filling the opening 3.

The powder film forming method can be arranged so that: the powder filling member (screen plate 2) includes a porous body (screen mesh 4) and a covering part (screen emulsion part 5) provided on one surface of the porous body (screen mesh 4); and the covering part (screen emulsion part 5) has the opening 3.

With the arrangement, it is possible to configure the powder filling member with use of a typical stainless steel mesh for screen printing.

The powder film forming method can be arranged so that: in the step (a), the opening 3 is filled with the powder 9 from a lower surface side of the opening 3 via the porous body (screen mesh 4) while (i) the covering part (screen emulsion part 5) is provided at a vertically upper side and (ii) the holding member (holding plate 6) is provided so as to block an upper surface side of the opening 3 of the covering part (screen emulsion part 5); and in the step (b), the porous body (screen mesh 4), which is filled with the powder 9 in the step (a), is inverted so as to form the powder film 11 on the substrate 10.

With the arrangement, it is possible to use a simple arrangement to secure, by the holding member (holding plate 6), a smooth state of the powder 9 which is filling the opening 3.

The powder film forming method can be arranged so that in the step (b), the powder 9 is moved to the substrate 10 by (i) causing the rubbing body 15 to rub the powder 9 into the opening 3 from a side of the powder filling member (screen plate 2), which side is opposite a side facing the substrate 10 or (ii) subjecting the opening 3 to vibration.

According to the arrangement, a smooth thickness state of the powder 9, which is filling the opening 3, is more accurately reflected in a powder film 11 to be formed.

The powder film forming device in accordance with each of Embodiments 6 through 8 includes: a powder filling member (screen plate 2) having an opening 3 to be filled with a powder 9 which is charged; and a power supply (direct current power supply 8) configured to generate an electric potential difference between the powder filling member (screen plate 2) and a substrate 10 in order to form a powder film 11 on the substrate 10 by causing the powder 9, which is filling the opening 3, to move to the substrate 10.

In order to attain the object, a powder film forming method in accordance with an aspect of the present invention is a method of forming a powder film, including the steps of: (a) filling an opening with a powder through rubbing by a rubbing body, the opening being formed in a powder filling member; and (b) forming the powder film, on the substrate, by generating an electric potential difference between the powder filling member and a substrate so as to cause the powder, which is filling the opening, to move to the substrate.

In order to attain the object, a powder film forming device in accordance with an aspect of the present invention includes: a powder filling member having an opening to be filled with a powder; a rubbing body configured to rub the powder into the opening from one end side of the opening so as to fill the opening with the powder; a holding member provided so as to be able to block the other end side of the opening; and a power supply configured to generate an electric potential difference between the powder filling member and a substrate in order to form a powder film on the substrate by causing the powder, which is filling the opening, to move to the substrate.

In order to attain the object, a powder film forming method in accordance with an aspect of the present invention includes the steps of: (a) filling an opening with a powder by vibrating the powder, the opening being formed in a powder filling member; and (b) forming the powder film on a substrate by causing the powder, which is filling the opening, to move to the substrate.

In order to attain the object, a powder film forming device in accordance with an aspect of the present invention includes: a powder filling member having an opening to be filled with a powder; a vibration exciting member configured to subject the powder filling member to vibration excitation so as to fill the opening with the powder; and a direct current power supply configured to apply a voltage between the powder filling member and a substrate so as to cause the powder to move to the substrate.

In order to attain the object, a powder film forming method in accordance with an aspect of the present invention is a method of forming a powder film, including the steps of: (a) filling an opening with a powder which is charged, the opening being formed in a powder filling member; and (b) forming the powder film, on the substrate, by generating an electric potential difference between the powder filling member and a substrate so as to cause the powder, which is filling the opening, to move to the substrate.

In order to attain the object, a powder film forming device in accordance with an aspect of the present invention includes: a powder filling member having an opening to be filled with a powder in which charged; and a power supply configured to generate an electric potential difference between the powder filling member and a substrate in order to form a powder film on the substrate by causing the powder, which is filling the opening, to move to the substrate.

An object of an aspect of the present invention is to achieve a powder film forming method and a powder film forming device, each of which allows a powder film, which is to be formed on a printed material, to have a thickness which is close to being uniform.

An object of an aspect of the present invention is to achieve a powder film forming method and a powder film forming device, each of which (i) allows a powder film, which is to be formed on a printed material, to have a thickness which is close to being uniform and (ii) shortens a period of time it takes to form a powder film.

An aspect of the present invention brings about an effect of allowing a powder film, which is to be formed on a printed material, to have a thickness which is close to being uniform.

An aspect of the present invention brings about an effect of (i) allowing a powder film, which is to be formed on a printed material, to have a thickness which is close to being uniform and (ii) shortening a period of time it takes to form a powder film.

REFERENCE SIGNS LIST

1 Powder film forming device
2 Screen plate (powder filling member)
3 Opening
4 Screen mesh (porous body)
5 Screen emulsion part (covering part)
6 Holding plate (holding member)
7 Vibration exciting member (vibration exciting section)
8 Direct current power supply (power supply)
9 Powder
10 Substrate
11 Powder film
15 Rubbing body
16 Printed material
17 Electrostatic spray

The invention claimed is:

1. A method of forming a powder film, comprising the steps of:

(a) filling an opening with a powder such that the powder is retained in the opening, the opening being formed in a powder filling member on a side facing a substrate, a shape of the opening corresponding to a shape of a powder film to be formed; and (b) forming the powder film by generating an electric potential difference between the powder filling member and the substrate so as to cause the powder retained in the opening to move to the substrate, wherein the powder filling member includes
a porous body, and
a covering part provided on one surface of the porous body;
wherein the covering part has the opening;

wherein, in the step (b), the covering part is provided on the side facing the substrate; and wherein filling the powder in the opening comprises providing the powder on the porous body from a side opposite to the opening causing the powder to pass through the porous body into the opening and retained in the opening.

2. The method according to claim 1, wherein, in the step (a), the powder is rubbed by a rubbing body so as to fill the opening.

3. The method according to claim 1, wherein, in the step (a), the powder is vibrated so as to fill the opening.

4. The method according to claim 1, wherein, in the step (a), the powder to fill the opening is charged.

5. The method according to claim 4, wherein, in the step (a), the powder, which is charged, is caused to fill the powder filling member by spraying with use of an electrostatic spray.

6. The method according to claim 1, wherein, in the step (b), the powder is rubbed by a rubbing body so as to move to the substrate.

7. The method according to claim 1, wherein, in the step (b), the powder is vibrated so as to move to the substrate.

8. The method according to claim 1, further comprising covering the opening with a holding plate disposed on the side facing the substrate, the holding plate preventing the powder from falling out of the opening during filling of the opening.

9. A method of forming a powder film, comprising the steps of:

(a) filling an opening with a powder by vibrating the powder such that the powder is retained in the opening, the opening being formed in a powder filling member on a side facing a substrate, a shape of the opening corresponding to a shape of the powder film to be formed; and (b) forming the powder film by causing the powder retained in the opening to move to the substrate, wherein the powder filling member includes
a porous body, and
a covering part provided on one surface of the porous body;
wherein the covering part has the opening;

wherein, in the step (b), the covering part is provided on the side facing the substrate; and wherein filling the powder in the opening comprises providing the powder on the porous body from a side opposite to the opening causing the powder to pass through the porous body into the opening and retained in the opening.

10. The method according to claim 9, wherein, in the step (b), the powder is rubbed by a rubbing body so as to move to the substrate.

11. The method according to claim 9, wherein, in the step (b), the powder is vibrated so as to move to the substrate.

12. A method of forming a powder film, comprising the steps of:

(a) filling an opening with a powder, the opening being formed in a powder filling member on a side facing a substrate, a shape of the opening corresponding to a shape of a powder film to be formed, the opening being filled with the powder from a side opposite to a porous body of the powder filling member, the porous body facing the substrate;

(b) inverting the powder filling member while the opening is being blocked with a holding plate so that the porous body faces away from the substrate; and (c) removing the holding plate from the opening and forming the powder film by generating an electric potential difference between the powder filling member and the substrate so as to cause the powder retained in the opening to move to the substrate.

* * * * *